US005851742A

United States Patent [19]

Nishio

[11] Patent Number: 5,851,742

[45] Date of Patent: Dec. 22, 1998

[54] SOLID PROCESSING COMPOSITION AND METHOD FOR PROCESSING SILVER HALIDE PHOTOGRAPHIC LIGHT-SENSITIVE MATERIAL

[75] Inventor: Shoji Nishio, Hino, Japan

[73] Assignee: Konica Corporation, Tokyo, Japan

[21] Appl. No.: 978,609

[22] Filed: Nov. 26, 1997

Related U.S. Application Data

[63] Continuation of Ser. No. 736,399, Oct. 24, 1996.

[30] Foreign Application Priority Data

Oct. 30, 1995 [JP] Japan ..... 7-281649

[51] Int. Cl.[6] ..... G03C 5/30

[52] U.S. Cl. ..... 430/465; 430/399

[58] Field of Search ..... 430/465, 399

[56] References Cited

U.S. PATENT DOCUMENTS

| | | | |
|---|---|---|---|
| 2,685,515 | 8/1954 | Wilson | 430/380 |
| 2,688,548 | 9/1954 | Reynolds | 430/380 |
| 2,688,549 | 9/1954 | James et al. | 430/380 |
| 4,816,384 | 3/1989 | Fruge et al. | 430/465 |
| 5,098,819 | 3/1992 | Knapp | 430/436 |
| 5,135,840 | 8/1992 | Reuter et al. | 430/465 |
| 5,278,036 | 1/1994 | Kobayashi et al. | 430/465 |
| 5,298,372 | 3/1994 | Okutsu et al. | 430/401 |
| 5,384,232 | 1/1995 | Bishop et al. | 430/446 |
| 5,578,414 | 11/1996 | Yamamoto et al. | 430/264 |

FOREIGN PATENT DOCUMENTS

| | | |
|---|---|---|
| 0 461 783 A1 | 12/1991 | European Pat. Off. . |
| 0 573 700 A1 | 12/1993 | European Pat. Off. . |
| 0 93/11456 | 6/1993 | WIPO . |

*Primary Examiner*—Hoa Van Le

*Attorney, Agent, or Firm*—Frishauf, Holtz, Goodman, Langer & Chick, P.C.

[57] ABSTRACT

A solid processing composition and method for processing a silver halide photographic light sensitive material is disclosed in which the solid processing composition has a sodium cation content of 60 mol % or more based on the total metal cation content, and contains a developing agent represented by the following formula (1):

formula (1)

7 Claims, No Drawings

SOLID PROCESSING COMPOSITION AND METHOD FOR PROCESSING SILVER HALIDE PHOTOGRAPHIC LIGHT-SENSITIVE MATERIAL

This application is a continuation of application Ser. No. 08/736,399, filed Oct. 24, 1996.

INDUSTRIAL FIELD OF THE INVENTION

The present invention relates to a solid processing composition and a method for processing a silver halide photographic light sensitive material, and particularly to a solid processing composition and a method for processing a silver halide photographic light sensitive material for graphic arts.

BACKGROUND OF THE INVENTION

Processing of silver halide photographic light sensitive materials is accomplished mainly with an automatic processor, due to stability, easiness, speed and handlability. Dihydroxybenzenes (mainly, hydroquinone) are used as a developing agent in almost all developers for processing a silver halide black-and-white photographic light sensitive material. However, the use thereof have problems that the developer blackening occurs due to aerial oxidation and hydroquinone polymer (referred to as scum) produced as a by-product is adhered to the conveying rollers in the processor or to a processed photographic material, resulting in deterioration in quality of the finished photographs.

A means for solving these problems is replacement of hydroquinone as a developing agent by ascorbic acid. However, processing by using (replenishing), over a long period of time, these developers which are disclosed in U.S. Pat. No. 5,236,816 and WO 93/11456 resulted in marked lowering of activity of the developer and insufficient process stability. The improvement has been eagerly sought.

SUMMARY OF THE INVENTION

Accordingly, an object of the invention is to provide a solid processing composition and a method for processing a silver halide photographic light sensitive material using a developer containing ascorbic acid or its derivative as a developing agent, wherein running stability is markedly increased, even when a large amount of light sensitive material are processed in a reduced replenish amount of developer replenisher.

Another object of the invention is to provide a processing composition and a method for processing a silver halide photographic light sensitive material, wherein running stability is markedly increased in view of sensitivity, gradation and dot quality.

DETAILED DESCRIPTION OF THE INVENTION

The above-mentioned object of the present invention has been attained by the followings;

(1) A solid processing composition for processing a silver halide photographic light sensitive material, wherein the sodium cation content of said solid composition is 60% or more based on the total metal cation, and the solid processing composition containing a developing agent represented by the following formula (1):

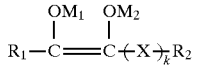

formula (1)

In the formula, $R_1$ and $R_2$ independently represent a substituted or unsubstituted alkyl group, a substituted or unsubstituted amino group or a substituted or unsubstituted alkylthio group, provided that $R_1$ and $R_2$ may combine with each other to form a ring; k is 0 or 1, provided that when k is 1, X is —CO—or —CS—; and $M_1$ and $M_2$ independently represent a hydrogen atom or an alkali metal, (2) The solid processing composition of (1) above, wherein the content ratio by mol of said developing agent represented by formula (1) to hydroquinone is 0.02 to 20.

(3) A method of processing a silver halide photographic light sensitive material, wherein the light sensitive material is developed using the solid processing composition of (1) or (2) above in an automatic processor.

(4) A method of processing a silver halide photographic light sensitive material comprising at least one photographic layer containing a hydrazine compound, wherein the light sensitive material is developed using the solid processing composition of (1) or (2) above in an automatic processor.

(5) A method of processing a silver halide photographic light sensitive material, wherein the light sensitive material is processed in an automatic processor, replenished with the solid processing composition of (1) or (2) above having been mixed with water in a mixer for dissolving.

(6) A method of processing a silver halide photographic light sensitive material comprising at least one photographic layer containing a hydrazine compound, wherein the light sensitive material is processed in an automatic processor, replenished with the solid processing composition of (1) or (2) above having been mixed with water in a mixer for dissolving.

The present invention will be detailed below.

A compound represented by the following formula (1-a), in which $R_1$ and $R_2$ combine with each other to form a ring in a compound represented by formula (1), is preferred.

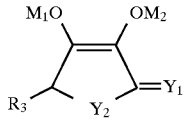

formula (1-a)

In formula (1-a), $R_3$ represents a hydrogen atom, a substituted or unsubstituted alkyl group, a substituted or unsubstituted aryl group, a substituted or unsubstituted amino group, a substituted or unsubstituted alkoxy group, a sulfo group, a carboxy group, an amido group or a sulfonamido group; $Y_1$ represents O or S; $Y_2$ represents O, S or $NR_4$, in which $R_4$ is a substituted or unsubstituted alkyl group or a substituted or unsubstituted aryl group; and $M_1$ and $M_2$ independently represent an a hydrogen atom or an alkali metal atom.

The alkyl group of formula (1) and formula (1-a) is preferably a lower alkyl group having 1 to 5 carbon atoms; the amino group is preferably a unsubstituted amino group or an amino group having a lower alkoxy group having 1 to 5 carbon atoms; the alkoxy group is preferably a lower alkoxy group having 1 to 5 carbon atoms; the aryl group is preferably a phenyl group or a naphthyl group; these groups may further have a substituent and the substituent is preferably a hydroxy group, a halogen atom, an alkoxy group, a sulfo group, a carboxy group, an amido group, or a sulfonamido group.

Examples of the compound represented by formulas (1) and (1-a) are shown below, but the present invention is not limited thereto.

| Compound No. | X | $R_1$ | $R_2$ | $M_1$ | $M_2$ |
|---|---|---|---|---|---|
| A-1 | — (k = 0) | $HOCH_2-CH(OH)-CH(OH)-$ | $-OH$ | H | H |
| A-2 | " | " | " | H | Na |
| A-3 | " | " | $-CH_3$ | H | H |
| A-4 | " | " | $-C_2H_5$ | H | H |
| A-5 | " | $CH_3-CH(OH)-CH(OH)-$ | $-OH$ | H | H |
| A-6 | " | " | " | H | Na |
| A-7 | " | " | $-CH_3$ | H | H |
| A-8 | " | " | $-CH_3$ | Na | H |
| A-9 | — (k = 0) | $CH_3-CH(OH)-CH(OH)-$ | $-C_2H_5$ | H | H |
| A-10 | $-C(=O)-$ (k = 1) | $HOCH_2-CH(OH)-CH(OH)-$ | $-OH$ | H | H |
| A-11 | " | " | " | Na | H |
| A-12 | " | " | $-CH_3$ | H | H |
| A-13 | " | " | $-CH_3$ | H | Na |
| A-14 | " | " | $-C_2H_5$ | H | H |
| A-15 | " | $CH_3-CH(OH)-CH(OH)-$ | $-OH$ | H | H |
| A-16 | " | " | " | Na | H |
| A-17 | $-C(=O)-$ (k = 1) | $CH_3-CH(OH)-CH(OH)-$ | $-CH_3$ | H | H |
| A-18 | " | " | $-C_2H_5$ | H | H |
| A-19 | " | $HO-CH_2-$ | $-OH$ | H | H |
| A-20 | " | " | $-OH$ | H | Na |
| A-21 | " | " | $-CH_3$ | H | H |
| A-22 | " | " | $-C_2H_5$ | H | H |
| A-23 | " | " | $-C_2H_5OH$ | H | H |
| A-24 | " | " | " | H | Na |
| A-25 | $-C(=S)-$ (k = 1) | $HOCH_2-CH(OH)-CH(OH)-$ | $-OH$ | H | H |
| A-26 | " | " | $-OH$ | H | Na |
| A-27 | " | " | $-CH_3$ | H | H |
| A-28 | " | $CH_3-CH(OH)-CH(OH)-$ | $-OH$ | H | H |
| A-29 | " | " | " | H | Na |
| A-30 | " | " | $-CH_3$ | Na | H |

| Compound No. | $Y_1$ | $Y_2$ | $R_3$ | $M_1$ | $M_2$ |
|---|---|---|---|---|---|
| A-31 | O | O | H | H | H |
| A-32 | O | O | $-CH_3$ | H | H |
| A-33 | O | O | " | H | Na |
| A-34 | O | O | " | Na | H |
| A-35 | O | O | $-CH_2(OH)$ | H | H |
| A-36 | O | O | " | H | Na |

-continued

| | | | | | |
|---|---|---|---|---|---|
| A-37 | O | O | $CH_3-CH(OH)-$ | H | H |
| A-38 | O | O | " | H | Na |
| A-39 | O | O | $HOCH_2-CH(OH)-$ | H | H |
| A-40 | O | O | " | H | Na |
| A-41 | O | O | " | Na | H |
| A-42 | O | O | $ClCH_2-CH(OH)-$ | H | H |
| A-43 | O | O | " | Na | H |
| A-44 | O | O | $HOOCCH_2-CH(OH)-$ | H | H |
| A-45 | O | O | " | Na | H |
| A-46 | S | O | H | H | H |
| A-47 | S | O | H | H | Na |
| A-48 | S | O | $CH_3-CH(OH)-$ | H | H |
| A-49 | S | O | " | Na | H |
| A-50 | S | O | $HOCH_2-CH(OH)-$ | H | H |
| A-51 | S | O | " | Na | H |
| A-52 | O | $NCH_3$ | H | H | H |
| A-53 | O | " | $HOCH_2-CH(OH)-$ | H | H |
| A-54 | O | " | " | H | Na |
| A-55 | O | NH | $HOCH_2-CH(OH)-$ | H | H |
| A-56 | O | NH | " | Na | H |
| A-57 | O | S | " | H | H |
| A-58 | O | S | " | Na | H |
| A-59 | O | S | " | H | Na |
| A-60 | O | S | $CH_3-CH(OH)-$ | H | H |
| A-61 | S | S | H | H | H |
| A-62 | S | S | H | H | Na |
| A-63 | S | S | $CH_3-CH(OH)-$ | H | H |
| A-64 | S | S | " | Na | H |
| A-65 | S | S | $HOCH_2-CH(OH)-$ | H | H |
| A-66 | S | S | " | H | Na |
| A-67 | S | S | " | Na | H |
| A-68 | S | S | " | H | K |

These compounds are typically ascorbic acid or erythorbic acid or derivatives thereof. They are available on the market and can be easily synthesized according to the well known synthesis method.

Any Na cation content ratio can be obtained by adjusting the content of a counter cation of an organic or inorganic salt used in a conventional black and white developer. The salt includes a sulfite, bisulfite, bicarbonate, carbonate, an alkali salt and an acid salt. The metal ion includes a lithium, potassium, calsium, barium, magnesium and aluminium ion.

In the invention the Na cation content is 60 mol % or more, preferably 70 mol % or more, and more preferably 80 to 95 mol %, based on the total cation content.

The content of the compound represented by formula (1) in the solid processing composition of the invention is preferably 30 to 70 weight %. The content ratio by mole of the compound represented by formula (1) to a hydroquinone developing agent in the solid processing composition of the invention is preferably 0.02 to 20, and more preferably 0.05 to 5. The compound represented by formula (1) is dissolved in water to obtain a developer replenishing solution. The developer replenishing solution contains the compound of formula (1) in an amount of preferably 0.0004 to 1 mol/liter.

The solid processing composition in the invention means granules or tablets obtained by granulating or molding into tablets a single component or plural components and particularly granules or tablets from which a developer can be prepared. The developer replenisher is a kit comprised of one to four parts form, preferably one or two parts. Most preferably, The developer replenisher is comprised of one part, in view of package opening operation or reduction of waste package.

The solid composition can be mechanically or manually dissolved in a conventional method as in a liquid composition. The tank for replenishing the composition may be provided within or outside an automatic processor. The supplying method of the solid composition may be any, as long as each componenet of the solid composition does not scatter. For example, a solid composition covered with a water soluble polymer film is directly incorporated into the tank as it is or a solid composition packaged in a paper laminated with a polyethylene is incorporated into a tank not to scatter the component or remaining the component in the package. The solid composition is preferably in the form of granules or tablets in view of its water solubility. However, some photographic processing components are sparingly soluble in water and often precipitate in the solution. In such cases, a solvent is further added.

In order to prepare granules or tablets, a granulating auxiliary agent is preferably employed and as the granulating auxiliary agent, a water soluble or an alkali or acid solution soluble polymer is employed. The polymer includes gelatin, pectin, sorbitol, mannitol, polyacrylic acid or its salt, polyvinyl alcohol, polyvinyl pyrrolidone, a vinyl acetate copolymer, polyethylene oxide, carboxymethylcellulose sodium, hydroxypropylcellulose, methylcellulose, ethylcellulose, alginates, gum arabic, tragacanth gum, karaya gum, carrageenin, methylvinyl ether-maleic anhydride copolymer, polyoxyethylenealkyl ether such as polyoxyethyleneethyl ether or polyoxyethylenestearyl ether, polyoxyethylenealkylphenyl ether such as polyoxyethyleneoctylpheyl ether or polyoxyethylenenonylphenyl ether and one selected from water soluble binders disclosed in Japanese Patent O.P.I. Publication No. 4-85535/1992.

In order to increase stability the components in the kit, the components may be sealed in separate two or more parts in the kit.

In the invention, the compound represented by Formula (1) can be used in combination with 3-pyrazolidones (for example, 1-phenyl-3-pyrazolidone, 1-phenyl-4-methyl-3-pyrazolidone, 1-phenyl-4, 4-dimethyl-3-pyrazolidone, 1-phenyl-4-ethyl-3-pyrazolidone, 1-phenyl-5-methyl-3-pyrazolidone) or aminophenols (for example, o-aminophenol, p-aminophenol, N-methyl-o-aminophenol, N-methyl-p-aminophenol, 2,4-diaminophenol). The 3-pyrazolidones or aminophenols are preferably used in an amount of 0.01 to 1,4 mol/liter of developer.

The solid processing composition in the invention may contain an anti-sludging agent disclosed in paragraphs 0079 to 0087 of Japanese Patent O.P.I. Publication No. 8-220703. The content of the anti-sludging agent is preferably $10^{-6}$ to $10^{-1}$ mol, and more preferably $10^{-5}$ to $10^{-2}$ mol per liter of developer.

The sulfites or metabisulfites as preservatives include sodium sulfite, potassium sulfite, ammonium sulfite and sodium metabisulfite. The amount used of the sulfite is not less than 0.25 mol per liter, and preferably not less than 0.4 mol per liter of developer.

The developer preferably contains an alkali agent (sodium hydroxide or potassium hydroxide) and a pH buffering agent (for example, carbonates, phosphates, borates, boric acid, acetic acid, citric acid or alkanol amines). The pH buffering agent is preferably carbonates, and the pH buffering agent content is preferably 0.5 to 2.5 mol, more preferably 0.75 to 1.5 mol per liter of developer. The developer optionally contains auxiliary solubility agents (for example, polyethylene glycols or esters thereof or alkanol amines), sensitizing agents (for example, non-ionic surfactants including polyoxy ethylenes or quaternary ammonium salts), surfactants, anti-foggants (for example, halides such as potassium bromide and sodium bromide, nitro benzindazole, nitro benzimidazole, benzotriazoles, benzothiazoles, tetrazoles or thiazoles), chelating agents (for example, ethylenediaminetetraacetic acid or an alkali metal salt thereof, nitrilotriacetic acid salts or polyphosphoric acid salts), development accelerators (for example, compounds described in U.S. Pat. No. 2,394,025 and Japanese Patent Publication No. 47-45541/1972), hardeners (for example, glutaraldehyde or a bisulfite adduct thereof) or anti-foaming agents. The pH of the developer is preferably adjusted to be 7.5 to less than 10.5, and more preferably 8.5 to 10.4.

The developer waste can be regenerated by applying electric current. A waste developer tank in which a cathode (for example, a conductor or semiconductor such as stainless wool) is provided and an electrolyte tank in which an anode (for example, a conductor such as carbon, gold, platinum or titanium) is provided are arranged in such a manner that the waste developer is in contact with the electrolyte solution through an anion exchange membrane. The waste developer is regenerated by applying electric current to both electrodes. The light sensitive material can be processed while applying electric current. On generating developer, to the developer are added various additives such as preservatives, alkali agents, pH buffering agents, sensitizing agents, anti-foggants or anti-silver sludge agents. The light sensitive materials can be processed while applying current to the developer, to which the above additives can be further added. When developer waste is regenerated, the developer preferably contains a transition metal complex as a developing agent.

As a particular case in which the developing agent is contained in the light sensitive material, for example, in the emulsion layer or in its adjacent layer, the light sensitive material may be developed with an alkali solution, which is an activator processing solution. Such a light sensitive material may be also developed with developer. Such a development is often used as one of rapid processes in combination with silver stabilizing treatment of a thiocyanate, and the compounds of the invention can be applied thereto.

A fixer having a conventional composition can be used. The fixer is usually an aqueous solution comprised of a fixing agent and other additives, and has a pH of 3.8 to 5.8. As the fixing agent, thiosulfates such as sodium thiosulfate, potassium thiosulfate or ammonium thiosulfate, thiocyanates such as sodium thiocyanate, potassium thiocyanate or ammonium thiocyanate, or organic sulfur compounds capable of producing soluble stable silver complexes can be used.

To the fixer can be added water soluble aluminum salts acting as a hardener such as aluminum chloride, aluminium sulfate and potash alum or aldehydes such as glutaraldehyde or its sulfite adduct. To the fixer can be optionally added preservatives such as sulfites or metabisulfites, pH buffering agents (for example, acetic acid), pH regulators (for example, sulfuric acid) or chelating agents capable of softening hard water.

In the invention the ammonium content of the fixer is preferably 0.1 mol or less per liter.

The ammonium content of the fixer is more preferably 0 to 0.05 mol per liter. Ammonium thiosulfate may be used instead of sodium thiosulfate, and a combination of ammonium thiosulfate and sodium thiosulfate may be used.

In the invention the acetic acid ion content of the fixer is preferably less than 0.33 mol per liter. Any kinds of actates which can dissociate an acetic acid ion in the fixer can be used. Actic acid or a lithium, potassium, sodium or ammonium salt of acetic acid is preferably used, and sodium or ammonium salt of acetic acid is especially preferable. The acetic acid ion content of the fixer is more preferably 0.22 mol or less per liter, and especially preferably 0.13 mol or less per liter, which can minimize acetic acid gas production. It is most preferable that the fixer contains no acetic acid.

The fixer preferably contains a thiosulfate. The thiosulfate includes a lithium, potassium, sodium or ammonium salt, and the sodium or ammonium salt is especially preferable. The thiosulfate content of the fixer is 0.15 to 5 mol per liter, preferably 0.5 to 2 mol per liter, more preferably 0.7 to 1.8 mol per liter, and most preferably 0.8 to 1.5 mol per liter.

The fixer optionally contains citric acid, tartaric acid, malic acid, succinic acid or its salt or its optical isomer. The citric acid, tartaric acid, malic acid or succinic acid salt includes their lithium, potassium, sodium or ammonium salts, a hydrogen lithium, hydrogen potassium, hydrogen sodium or hydrogen ammonium salt of tartaric acid or ammonium potassium or ammonium sodium salt of tartaric acid.

In the invention the fixed material is washed with washing water or processed with stabilizer. In order to stabilize an image, the stabilizer optionally contains an organic or inorganic acid or its salt for adjusting a layer pH (to have a layer pH of 3 to 8), an alkali agent or its salt (for example, borates, metaborates, borax, phosphates, carbonates, potassium hydroxide, sodium hydroxide, aqueous ammonia, monocarboxylic acids, dicarboxylic acids, polycarboxylic acids, citric acid, oxalic acid, malic acid or acetic acid or a combination thereof, aldehydes (for example, formalin, glyoxal, glutaraldehyde), a chelating agent (for example, ethylenediamine tetraacetic acid or its alkali metal salt, nitrilotriacetic acid or polyphosphoric acid), anti-molds (for example, phenol, 4-chlorophenol, cresol, o-phenylphenol, chlorophene, dichlorophene, formaldehyde, p-hydroxybenzoic acid ester, 2-(4-thiazoline)benzimidazol, benzisothiazoline-3-one, dodecyl-benzyl-methylammonium chloride, N-(fluorodichloromethylthio)-phthalimide, 2,4,4'-trichloro-2'-hydroxydiphenylether), tone adjusting agent and/or anti-staining agents (for example, a nitrogen-containing heterocyclic compound having a mercato group, for example, 2-mercapto-5-sodiumsulfo-benzimidazole, 1-phenyl-5-mercaptotetrazole, 2-mercaptobenzothiazole, 20mercapto-5-propyl-1,3,4-triazole or 2-mercaptohypoxanthine). Of these, the stabilizer preferably contains anti-molds. These agents can be replenished in a liquid or solid form. When replenished in a solid form, the solid composition can be prepared or employed according to the method described above.

In the invention, in order to minimize a waste solution, light sensitive material is processed while a specific amount of developer and fixer replenisher is replenished in proportion to an area of the light sensitive material to be processed. The replenishing amounts of the developer and fixer replenisher are 330 ml or less, preferably 30 to 200 ml per $m^2$ of light sensitive material. The replenishing amount of the developer and fixer replenisher herein referred to is a liquid amount replenished. When the mother developer and fixer developer are replenished, the replenishing amount is a replenishing amount thereof. When a concentrated developer and its diluting water, and a concentrated fixer and its diluting water are replenished, the replenishing amount is a total replenishing amount of the concentrated developer and its diluting water, and a total replenishing amount of a concentrated fixer and its diluting water. When a developer in which a solid developer is dissolved in water and a fixer in which a solid fixer is dissolved in water are replenished, the replenishing amount is a total volume of the solid developer and water, and a total volume of the solid fixer and water, respectively. When a solid processing composition is directly replenished in a processing tank of an automatic processor, the replenishing amount is preferably represented in terms of a total volume of the solid processing composition and water separately replenished. The developer replenisher and fixer replenisher may be the same as or different from a mother developer in the developer tank and a fixer developer in the fixer tank in an automatic processor, or may be also a solid developer or solid fixer. Particularly, when the developer replenisher is replenished in an amount of 120 ml or less per $m^2$ of light sensitive material, the replenisher is preferably different from a mother developer in the developing tank of an automatic processor or a solid developer. The content of an anti-sludging agent having a mercapto group contained in the developer replenisher is preferably higher than that in the mother developer. The content of a compound of the invention represented by formula (1) or a transition metal complex in the developer replenisher is preferably 1.2 to 4 times higher than that in the mother developer. Particularly, when the fixer replenisher is replenished in an amount of 150 ml or less per $m^2$ of light sensitive material, the fixer replenisher is preferably different from a mother fixer in the fixer tank of an automatic processor or a solid fixer. The content of a thiosulfate contained in the fixer replenisher is preferably higher than that in the mother fixer.

The solid processing composition in the invention may be dissolved in water. The temperatures of developer, fixer, washing and stabilizing bath are preferably from 10° C. to 45° C., and may be adjusted separately.

In the invention, when using an automatic developing apparatus, the total processing time (Dry to Dry processing time) is preferably 10–150 seconds. The total processing time is the time taken from the entry of the leading edge of a film in the apparatus to the delivery of the tail end of the film out of the drying zone of the apparatus. The total processing time referred to herein is the total time necessary to process black-and-white silver halide photographic light-sensitive material, and concretely, the time necessary to carry out the steps, developing, fixing, bleaching, washing or stabilizing and drying, which is Dry to Dry time. Dry to Dry processing time less than 10 seconds results in desensitizing and low contrast, and does not exhibit satisfactory results. Dry to Dry processing time is more preferably 25 to 120 seconds. In order to running process stably 10 $m^2$ or more of light sensitive material, developing time is preferably 2–45 seconds.

In order to markedly effect the invention, an automatic processor preferably comprises a drying zone in which heat conductors of 60° C. or more (for example, a heat roller of 60°–130° C. or more) or heat radiation materials of 150° C. or more (for example, a material such as tungsten, carbon, nichrome, zirconium oxide-yttrium oxide-thorium mixture or silicon carbide emitting an infrared light by applying electric current or a heat heat conductor such as copper, stainless steel, nickel, or ceramics heated by transfer of heat from heat radiation materials) are provided.

The heat conductor of 60° C. or more includes a heat roller. The heat roller is preferably an aluminium hollow roller covered with a silicone rubber, polyurethane or teflon. Both ends of the heat roller are preferably supported rotatably by bearings made of a heat resistant resin (for example, Rulon) embedded in side walls of a drying zone.

A gear is provided at one end of the heat roller, and preferably is rotated in the conveying direction by a driving means or a drive transmission means. The heat roller contains a halogen heater therein which preferably connects a temperature controller provided in an automatic processor.

The temperature controller connects a thermistor contact-provided at the periphery of the heat roller. It is preferable that the temperature controller controls a temperature to switch on or off the halogen heater so that a temperature detected by the thermistor is within the range of 60° to 150° C., preferably 70° to 130° C.

The heat radiation materials of 150° C. or more (preferably 250° C. or more) include the followings: tungsten, carbon, tantalum, nichrome, zirconium oxide-yttrium oxide-thorium mixture, silicon carbide, molybdenum bisilicide or lanthanum chromate. The heat radiation is controlled by applying electric current to the materials or by transfer heat from the materials to a heat conductor such as copper, stainless steel, nickel, or ceramics.

In the invention a combination of a 60° C. or more heat conductor and a 150° C. or more heat radiation material may be used. further, a conventional 60° C. or less heated air may be used in combination.

The silver halide composition of the silver halide emulsion used in the invention is not limited, but when processed with reduced replenishment of a processing solution or rapidly processed, a silver halide emulsion containing silver chloride, or silver bromochloride or bromoiodochloride having a silver chloride content of 60 mol % or more is preferable.

The average grain size of the silver halide grains is preferably not more than 1.2 $\mu$m, and more preferably 0.1 to 0.8 $\mu$m. The average grain size is common in the photographic art and commonly used technical term. The grain size herein referred to is a grain diameter when grains are spherical or approximately spherical. When cubic, the size is a diameter in terms of spheres. A method of measuring the average grain size is detailed in T. H. James, "The Theory of the Photographic Process", the third edition, p. 36–43, (1966, issued by Mcmillan Co. Ltd.).

The silver halide grain shape is not specifically limited, and may be tabular, spherical, cubic, tetradecahedral, octahedral and the like. The grain size distribution is preferably narrow, and the silver halide emulsion is preferably a monodisperse emulsion in which 90% or more preferably 95% or more of the grains fall within the range of ±40% of the average grain size.

As a method of reacting a soluble silver ion with a soluble halide in the manufacture of a silver halide emulsion, a normal precipitation method, a double jet precipitation method or a combination thereof can be used. A method of forming grains in the presence of an excess silver ion, so-called a reverse precipitation method can be used. As one method of the double jet precipitation, a method of maintaining pAg of the silver halide forming solution constant, so-called a controlled double jet method can be used. According to this method, silver halide grains of regular shape having an approximately uniform grain size.

In order to markedly effect the invention, it is preferable that the silver halide emulsion of at least one silver halide emulsion layer comprises tabular grains in which 50% or more of the total grain projected area are a total projected area of tabular grains having an aspect ratio of 2 or more. As the tabular grains increases to 60%, 70% and 80%, the preferable results are obtained. The aspect ratio is a ratio of a distance between two parallel planes to a diameter of a circle having the same area as a projected area of tabular grains. The silver halide grains having a silver chloride content of 50 mol % or more have a major face (100), and can be represented in terms of a longitudinal/lateral length ratio instead of the aspect ratio. The length ratio is preferably 1.2 to 8. The nuclear forming site inside grains may contain iodine in an amount of 0.001 to 1 mol %. The tabular silver halide grains having a high content of silver chloride is disclosed in U.S. Pat. No. 5,320,938. It is preferable in view of pressure resistance of grains that the inner portions of the grains have a high silver iodide content of 0.001 to less than 10% or silver nuclei. As the aspect ration or longitudinal/lateral length ratio increases, grains are more tabular. The preferable thickness is 0.01 to 0.5 $\mu$m, but can be selected depending on the aspect ratio and an average volume grain diameter of grains. The silver halide emulsion is preferably a monodisperse emulsion in which grain diameter distribution is 30% or less, especially 20% or less. The distribution is represented by grain diameter variation coefficient, a grain diameter standard variation R divided by the diameter D, S/D×100, the grain diameter being a diameter of a circle corresponding to a projected area of the grains. The tabular grains and normal crystal grains can be used in combination.

The tabular silver halide grains are preferably tabular grains having a silver chloride content of 50 mol % or more and a major face (100). These grains are disclosed in U.S. Pat. Nos. 5,264,337, 5,314,798 and 5,320,958, and can be easily obtained. The tabular grains can be prepared to epitaxially grow silver halide having a different composition at the specific surface or cover the surface with the silver halide. The grains can be prepared to have a transition line inside the grains in order to control sensitivity nuclei. The transition line can be formed by carrying chemical sensitization in the presence of silver iodide fine particles or an iodine ion. The silver halide grains are preferably doped with a metal under an acidic condition of pH 1–5. In order to control grain growth during formation, silver halide solvents such as ammonia, thioethers, thioureas and thions can be used.

The emulsion may contain a metal such as zinc, lead, thallium, iridium, rhodium, ruthenium, osmium, palladium, or platinum. In order to obtain high intensity properties, the silver halide grains are often doped with iridium in an amount of $10^{-9}$ to $10^{-3}$ per mol of silver halide. In the invention, in order to obtain a high contrast emulsion, the silver halide grains are preferably doped with rhodium, ruthenium, osmium or rhenium in an amount of $10^{-9}$ to $10^{-3}$ mol per mol of silver halide.

A metal complex, in which halogen, carbonyl, nitrosil, amine, cyan, thiocyan, ammonia, tellurocyan, selenocyan, dipyridyl, tripyridyl, phenanthroline or a compound thereof is coordinated with a metal, is added to silver halide grains. The oxidation condition of a metal is selected from the maximum oxidation level to the minimum oxidation level. The preferable ligand is a hexadentate ligand disclosed in Japanese Patent O.P.I. Publication Nos. 2-2082/1990, 2-20853/1990, 2-20854/1990 and 2-20855/1990, a sodium, potassium or cesium salt as an alkalicomplex or a primary, secondary or tertiary amine salt. A transition metal complex can be formed as an aquocomplex. The example includes $K_2[RuCl_6]$, $(NH_4)_2$ $[RuCl_6]$, $K_2[Ru(NO)Cl_6(SCN)]$, and $K_2[RuCl_5(H_2O)]$. A compound in which Ru in the example is replaced with Rh, Os, Ir, Pd or Pt can be used.

A rhodium, ruthenium, osmium or rhenium compound is preferably added during formation of silver halide grains. There is a method of uniformly dispersing the compound in the grains or localizing the compound at a core or shell portion of a core/shell structure.

The silve halide grains having more of the compound in the shell gives good results. A method of continuously incresaing the amount in the outerward may be used in addition to a method localizing the compound in the incontinuous phase. The addition amount of the compound is optionally selected in the range of from $10^{-9}$ to $10^{-3}$ mol per mol of Ag.

The silver halide emulsion and the preparing method thereof are detailed in Research and Disclosure (RD), 176, 17643, p. 22–23 (December, 1978) or in references cited in the same.

The silver halide emulsion may be chemically sensitized or may not. The chemical sensitization method includes sulfur, reduction, selenium, tellurium or noble metal sensitization, and this may be used singly or in combination. The sulfur sensitizer may be a conventional sulfur sensitizer, but the preferable sulfur sensitizer includes various sulfur compounds such thiosulfates, thiourea, rhodanines or polysulfides, in addition to a sulfur compound contained in gelatin. The selenium sensitizer may be a conventional selenium sensitizer, and is preferably those disclosed in U.S. Pat. No. 1,623,499, and Japanese Patent O.P.I. Publication Nos. 50-71324/1985 and 60-150046/1985.

The tellurium sensitizer may be a conventional tellurium sensitizer, and is preferably those disclosed in U.S. Pat. Nos. 1,623,499, 3.772,031 and 3,320,069.

The typical noble metal sensitization is gold sensitization. The complex of a noble metal other than gold, for example, platinum, palladium or rhodium can be used.

The reduction sensitizer includes stannous salts, amines, formamidines, sulfinic acids or silane compounds.

When this sensitizer is added in a fine particle dispersion, sensitization is increased. When AgI grains are added in a fine particle dispersion during chemical sensitization, AgI is formed on the surface of grains and dye sensitization is increased. When AgI is formed on tabular grains, contribution of transition lines of 0 to 1000 is often used.

The silver halide emulsion can be spectrally sensitized by sensitizing dyes. The sensitizing dyes includes cyanine dyes, merocyanine dyes, complex cyanine dyes, complex merocyanine dyes, holopolar cyanine dyes, hemicyanine dyes, styryl dyes or hemioxonol dyes. The dyes may contain any nucleus ordinarily used in cyanine dyes as a basic heterocyclic ring. The ring includes a pyrroline, oxazoline, thiazoline, pyrrole, oxazole, thiazole, selenazole, imidazole, tetrazole or pyridine nucleus, or its ring condensed with an aliphatic or aromatic hydrocarbon ring including an indolenine, indol, benzoxazole, benzothiazole, naphthothiazole, benzoselenazole, benzimidazole or quinoline nucleus. These nucleus may have a substituent. The merocyanine dyes or complex merocyanine dyes include, as a nucleus containing keto-methylene, a 5- or 6-membered heterocyclic ring such as a pyrazoline-5-one, thiohydantoin, 2-thiooxazolidine-2,4-dione, thiazolidine-2,4-one or rhodanine, thiobarbituric acid nucleus. Typically, those disclosed in (RD) above, 176, 17643 (December, 1978), p. 23 and 24, (RD) 34686 (1993), U.S. Pat. Nos. 4,425,425 and 4,425,426 are employed. The dyes may be dissloved employing a ultrasonic vibration disclosed in U.S. Pat. No. 3,485,634. The method of dissolving or dispersing dyes in a solvent and adding to an emulsion includes those disclosed in U.S. Pat. Nos. 3,482,981, 3,585,195, 3,469,987, 3,425,835 and 3,342,605, British Patent Nos. 1,271,329, 1,038,029 and 1,121,174 and U.S. Pat. Nos. 3,660,101 and 3,658,546. Thes dyes may be used singly or in combination, and a combination thereof is often used for supersensitization. A dye combination or substances, which show supersenstization, are disclosed in (RD), 176, 17643 (December, 1978), p. 23, section IV.

The light sensitive material used in the invention preferably contains a hydrazine derivative in view of the effect of the invention.

The hydrazine derivative is a compound represented by the following Formula [H]:

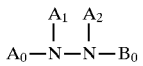

Formula [H]

In Formula [H], $A_0$ represents an aliphatic group, an aromatic group or a heterocyclic group. The aliphatic group represented by $A_0$ represents preferably a group having 1 to 30 carbon atoms, and more preferably a straight-chained, branched or cyclic alkyl group having 1 to 20 carbon atoms. The example includes a methyl, ethyl, t-butyl, octyl, cyclohexyl or benzyl group, each of which may have a substituent such as an aryl, alkoxy, aryloxy, alkylthio, arylthio, sulfoxy, sulfonamide, sulfamoyl, acylamino, or ureido group.

The heterocyclic group represented by $A_0$ represents preferably an aryl group with a single or condensed ring such as a benzene ring or a naphthalene ring.

The heterocyclic group represented by $A_0$ represents preferably a heterocyclic group with a single or condensed ring containing one hetero atom selected from a nitrogen, sulfur and oxygen atom, for example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring or a furan ring.

$A_0$ especially preferably represents an aryl group or a heterocyclic group. The aryl or heterocyclic group of $A_0$ has preferably a substituent. The examples of the substituent include an alkyl group, an aralkyl group, an alkinyl group, an alkoxy group, a substituted amino group, an acylamino group, a sulfonylamino group, a ureido group, a urethane group, an aryloxy group, a sulfamoyl group, a carbamoyl group, an alkylthio group, an arylthio group, a sulfothio group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamide group, a sulfonamide group, a carboxy group or a phosphonamide group. These substituents may further have a substituent.

When a light sensitive material is processed employing a developer having a pH of not more than 10.5 in a total processing time (Dry to Dry processing time) of 60 seconds or less, a compound having an acidic group giving a $PK_a$ of 7 to 11 such a sulfonamide group, a hydroxy group or a mercapto group is preferably used. The especially preferable is a compound having a sulfonamide group.

$A_0$ preferably has at least one of a non-diffusible group and a silver halide adsorption group. The non-diffusible group is preferably a ballast group which is conventionally used in immobile photographic additives such as couplers, and the ballast group includes an alkyl, alkenyl, alkinyl or alkoxy group having not less than 8 carbon atoms or a phenyl, phenoxy or alkylphenoxy group, which is relatively inactive to photographic properties.

The silver halide adsorption group includes a thiourea, thiourethane, mercapto, thioether, thion, heterocyclic, thioamidoheterocyclic or mercaptoheterocyclic group or an adsorption group described in Japanese Patent O.P.I. Publication No. 64-90439/1989.

$B_0$ represents a blocking group, and preferably represents —$G_0$—$D_0$—, wherein $G_0$ represents —CO—, —COCO—, —CS—, —C(=$NG_1D_1$)—, —SO—, —$SO_2$— or —P(O)($G_1D_1$)— in which $G_1$ represents a single bond, —O—, —S— or —N($D_1$)—, in which $D_1$ represents a hydrogen atom, an aliphatic group, an aromatic group or a heterocyclic group, provided that when plural $D_1$s are present in the molecule, $D_1$ may be the same or different.

$D_0$ represents a hydrogen atom, an aliphatic group, an aromatic group, a heterocyclic group, an amino group, an alkoxy group, an aryloxy group, an alkylthio group or an arylthio group.

$G_0$ preferably represents —CO—or —COCO—, and especially preferably —COCO—. $D_0$ preferably represents a hydrogen atom, an alkoxy group or an amino group.

$A_1$ and $A_2$ represent both hydrogen atoms or one of $A_1$ and $A_2$ represents a hydrogen atom and the other represents an acyl group (acetyl, trifluoroacetyl, benzoyl), a sulfonyl group (methanesulfonyl, toluenesulfonyl) or an oxalyl group (ethoxalyl).

The Exemplified compounds represented by Formula [H] will be shown below, but the invention is not limited thereto.

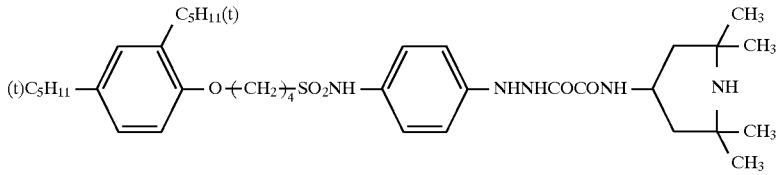

H-1

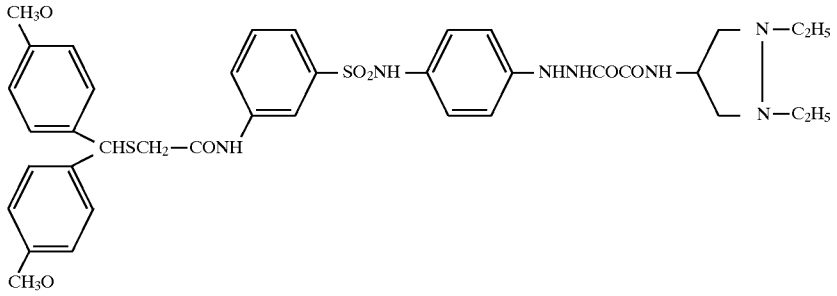

H-2

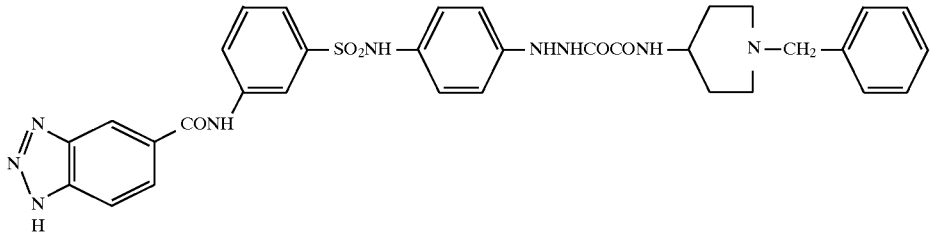

H-3

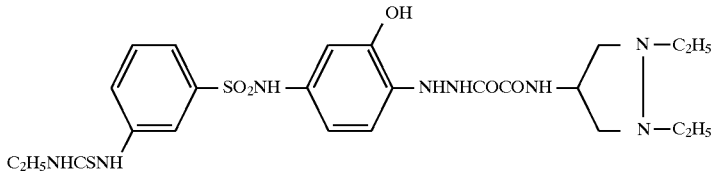

H-4

-continued
H-5
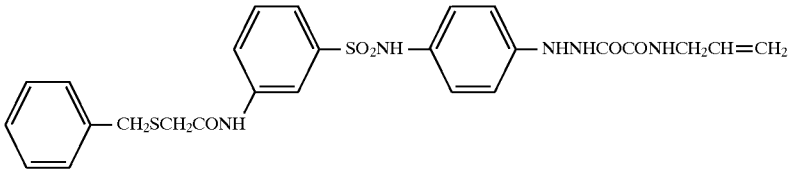
H-6
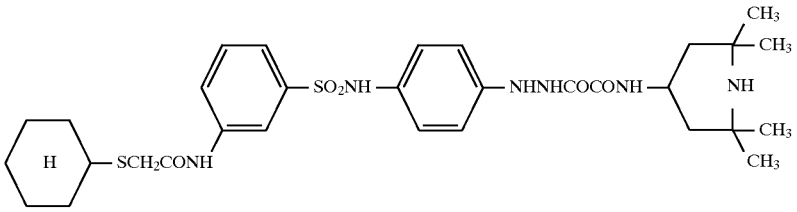
H-7
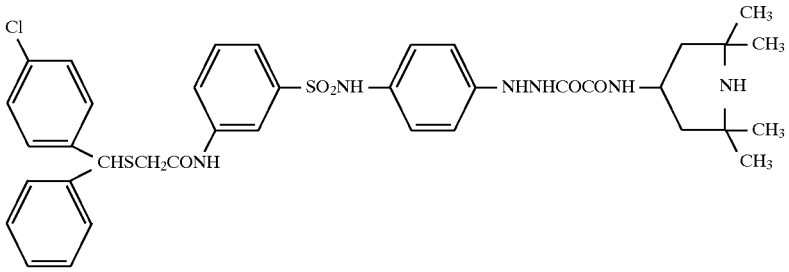
H-8
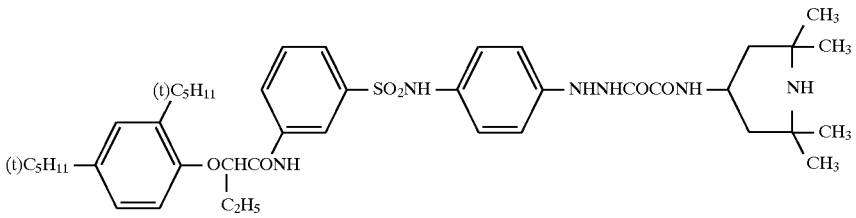
H-9
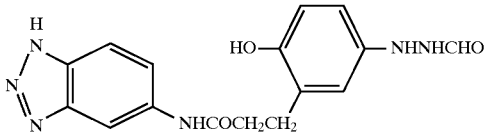
H-10
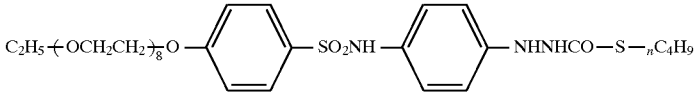
H-11
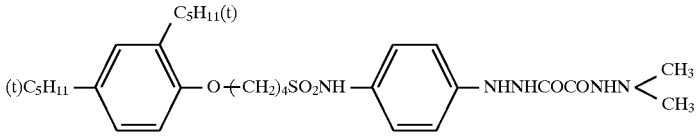
H-12
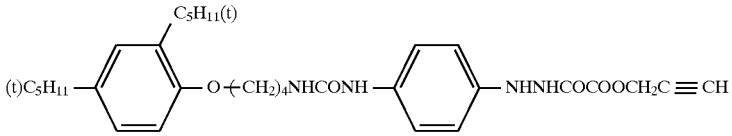
H-13
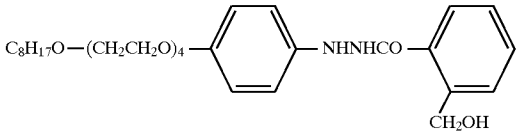

-continued
H-14
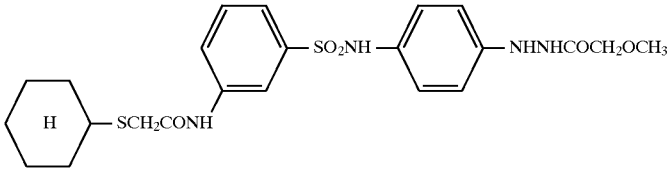
H-15
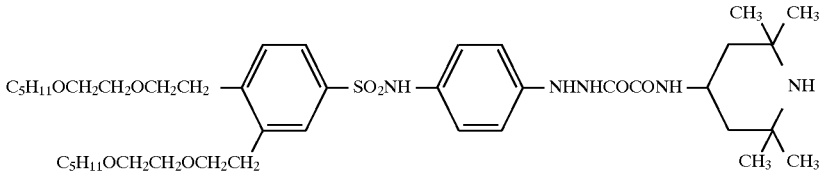
H-16
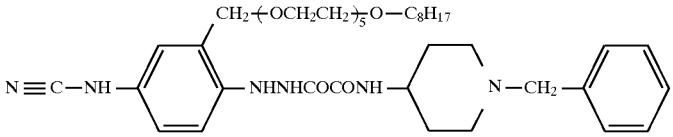
H-17
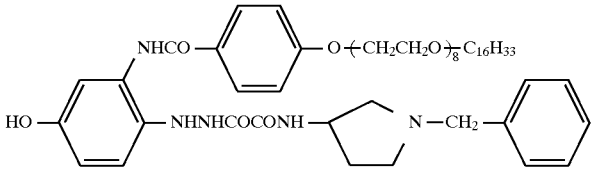
H-18
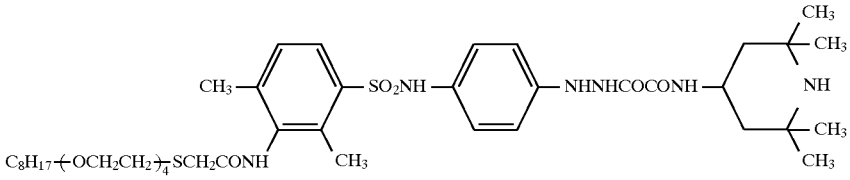
H-19
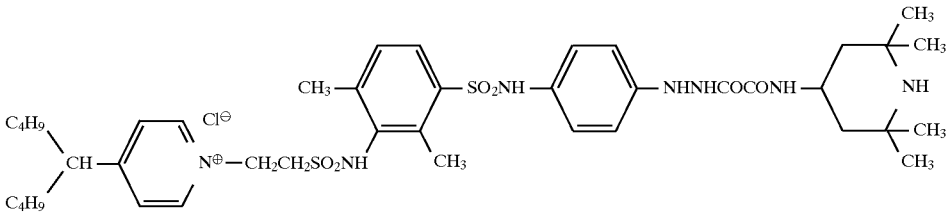
H-20
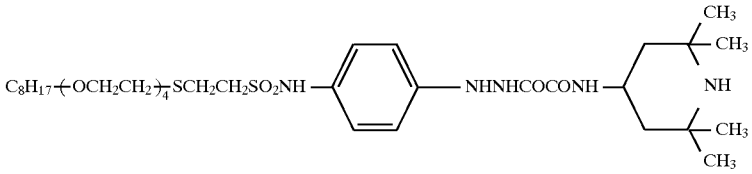
H-21
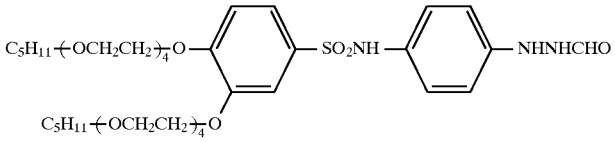
H-22
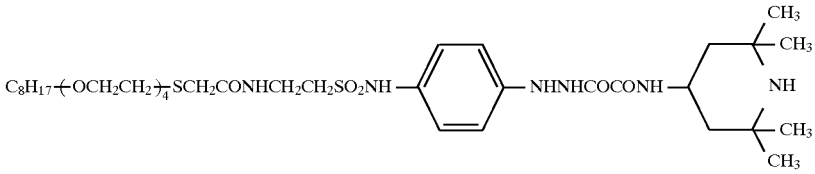

-continued

H-23

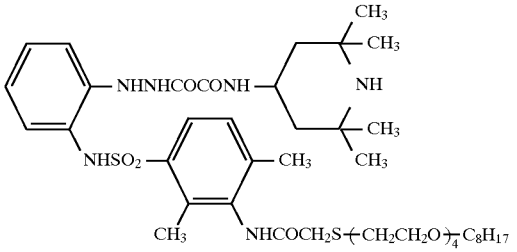

H-24

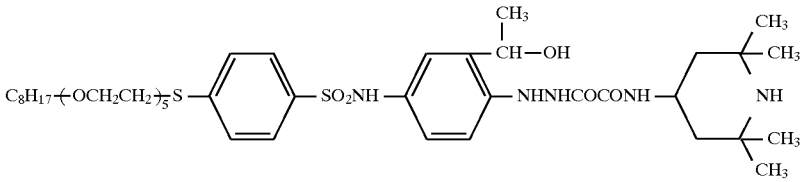

H-25

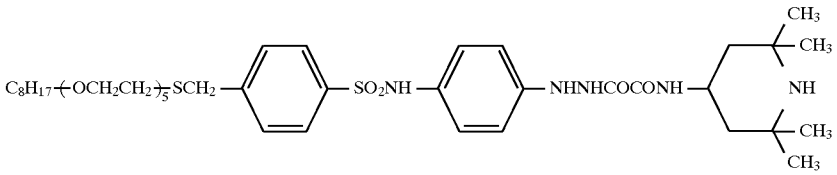

In the invention, when a hydrazine derivative is used, a nucleation accelerating agent represented by the following Formula [Na] or [Nb] is preferably used in order to effectively promote contrast increase.

Formula [Na]

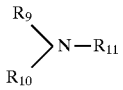

Formula [Nb]

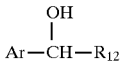

In Formula [Na], $R_9$, $R_{10}$ and $R_{11}$ independently represent a hydrogen atom, an alkyl group, a substituted alkyl group, an alkenyl group, a substituted alkenyl group, an alkinyl group, an aryl group or a substituted aryl group or $R_9$, $R_{10}$ and $R_{11}$ form a ring together.

The preferable agent is an aliphatic tertiary amines. These compounds preferably have in the molecule a non-diffusible group or a silver halide adsorption group. The compounds having non-diffusible property have preferably a molecular weight not less than 100, and more preferably a molecular weight not less than 300. The preferable adsorption group includes a heterocyclic, mercapto, thioether, thion or thiourea group.

The preferable of Formula [Na] is represented by the following Formula [Na-a].

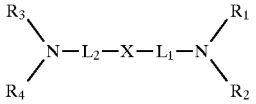

In Formula [Na-a], $R^1$, $R^1$, $R^3$ and $R^4$ independently represent a hydrogen atom, an alkyl group, a substituted alkyl group, an alkenyl group, a substituted alkenyl group, an alkinyl group, a substituted alkinyl group, an aryl group, a substituted aryl group or a saturated or unsaturated heterocyclic group or $R^1$ and $R^2$, or $R^3$ and $R^4$ combine with each other to form a ring. $R^1$ and $R^2$ are not simultaneously hydrogen atoms. $R^3$ and $R^4$ are not simultaneously hydrogen atoms.

X represents an S, Se or Te atom.

$L_1$ and $L_2$ independently represent a divalent likage group. The example includes the linkage group shown below, each of which may have a substituent (for example, alkylene, alkenylene, arylene, acylamino or sulfonamide). —$CH_2$—, —CH═CH—, —$C_2H_4$—, pyridyl, —N($Z_1$)— (in which $Z_1$ represents a hydrogen atom, an alkyl group or an aryl group), —O—, —S—, —(CO)—, —($SO_2$)—, —$CH_2$—. The linkage group preferably contains at least one of the following groups:

—[$CH_2$—$CH_2O$], —[C($CH_3$)$HCH_2O$]—, —[OC($CH_3$)$HCH_2O$]—, —[$OCH_2C$(OH)$HCH_2$]—.

The Exemplified compounds represented by Formula [Na] will be shown below.

Na-1

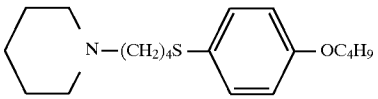

-continued
$[(C_3H_7)_2N(CH_2)_3OCH_2CH_2]_2S$ Na-2
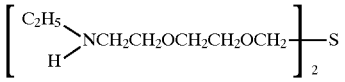
Na-3
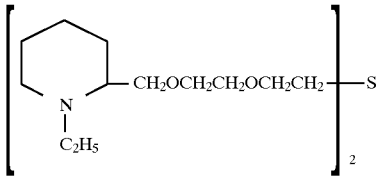
Na-4
$C_8H_{17}SCH_2CH_2N(CH_2CH_2O)_mH(CH_2CH_2O)_nH$ m + n = 20 Na-5
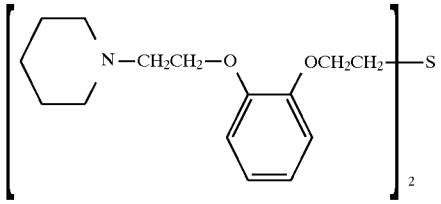
Na-6
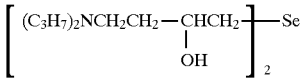
Na-7
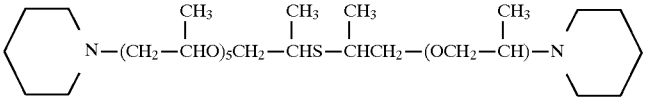
Na-8
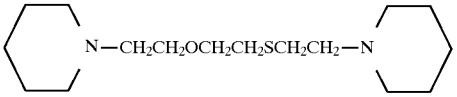
Na-9
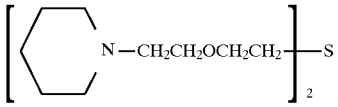
Na-10
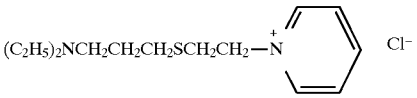
Na-11
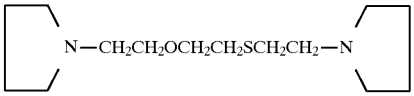
Na-12
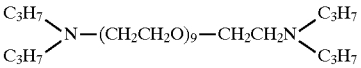
Na-13
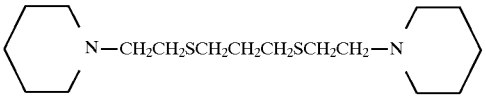
Na-14
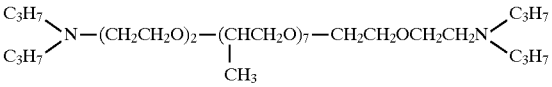
Na-15
$[(C_2H_5)_2N(CH_2)_3NHCOCH_2]_2Se$ Na-16

-continued

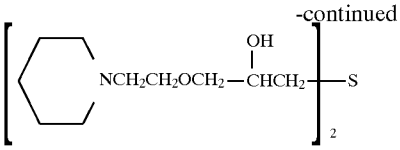

Na-17

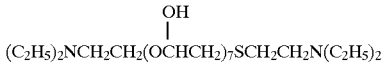

Na-18

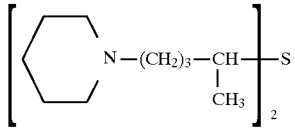

Na-19

In Formula [Nb], Ar represents a substituted or unsubstituted, aryl or heterocyclic group. $R_{12}$ represents a hydrogen atom, an alkyl group, an alkinyl group or an aryl group or Ar and $R_{12}$ combine ethrogugh another linkage group to form a ring. These compounds preferably have in the molecule a non-diffusible group or a silver halide adsorption group. The compounds having non-diffusible property have preferably a molecular weight not less than 120, and more preferably a molecular weight not less than 300. The preferable adsorption group includes the same as those denoted in Formula [H].

The Exemplified compounds represented by Formula [Nb] will be shown below.

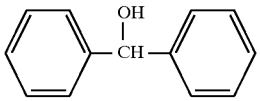

Nb-1

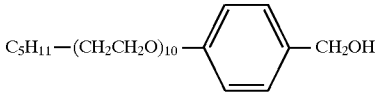

Nb-2

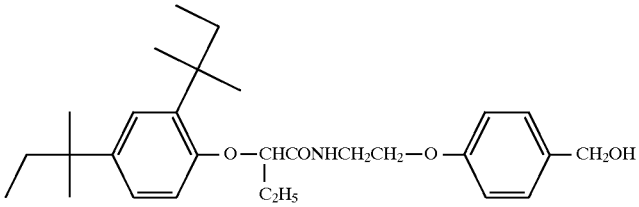

Nb-3

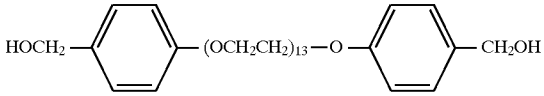

Nb-4

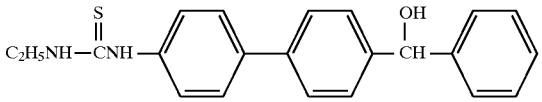

Nb-5

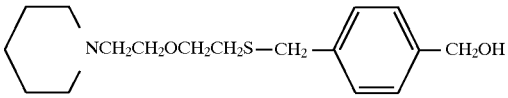

Nb-6

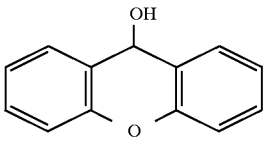

Nb-7

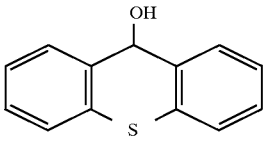

Nb-8

-continued

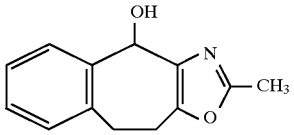

Nb-9

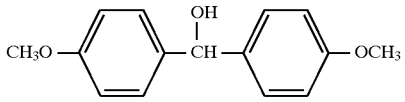

Nb-10

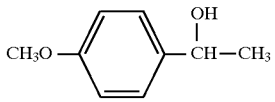

Nb-11

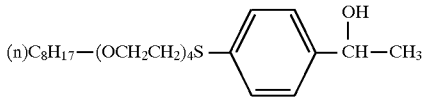

Nb-12

The silver halide photographic light sensitive material used in the invention may contain a tetrazolium compound. The tetrazolium compound is a compound represented by the following Formula [T]:

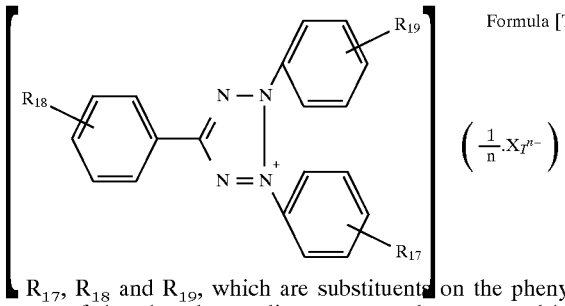

Formula [T]

$R_{17}$, $R_{18}$ and $R_{19}$, which are substituents on the phenyl group of the phenyltetrazolium compound represented by Formula [T], independently represent preferably a hydrogen atom or a group having a negative value of a Hammett's sigma value (σP) representing electron attractivity.

The Hammett's value in the phenyl group is described in many literatures, for example, C. Hansch, Journal of Medical Chemistry, 20, p. 304 (1977). In Formula [T], the examples having a especially preferable negative sigma value include, for example, methyl (σP=−0.17, hereinafter represented by a sigma value), ethyl (−0.15), cyclopropyl (−0.21), n-propyl (−0.13), isopropyl (−0.15), cyclobutyl (−0.15), n-butyl (−0.16), isobutyl (−0.20), n-pentyl (−0.15), cyclohexyl (−0.22), amino (−0.66), acetylamino (−0.15), hydroxyl (−0.37), methoxy (−0.27), ethoxy (−0.24), propoxy (−0.55), butoxy (−0.32), and pentoxy (−0.34). These are useful for the substituents of the compound represented by Formula [T].

n represents 1 or 2, and the anion represented by $X_T^{n-}$ includes, for example, a halogen ion such as a chloride ion, a bromide ion or an iodide ion, an inorganic acid residue such as nitric acid, sulfuric acid or perchloric acid, an organic acid residue such as sulfonic acid or carboxylic acid, an anionic surface active agent typically including a lower alkyl benzene sulfonic acid anion such as a p-toluene sulfonic acid anion, a higher alkyl benzene sulfonic acid anion such as a p-dodecyl benzene sulfonic acid anion, a higher alkyl sulfate anion such as a lauryl sulfate anion, a borate anion such as a tetraphenyl borate, a dialkyl sulfosuccinate anion such as a di-2-ethylhexyl succinate anion, a higher aliphatic anion such as a cetyl polyetenoxy sulfate anion, and a polymer with an acid residue such as a polyacrylic acid anion.

The typical examples of compounds represented by Formula [T] will be given below, but the compounds of the invention shall not be limited thereto.

| Compound No. | $R_{17}$ | $R_{18}$ | $R_{19}$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_5H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | P-$NH_2$ | H | H | $Cl^-$ |
| T-18 | p-$CH_3$ | H | p-$CH_3$ | $ClO_4^-$ |

The above tetrazolium compounds can be easily synthesized according to a method as disclosed in Chemical Reviews, 55, p. 335–483.

The compounds represented by Formula [T] can be used singly or in combination.

The hydrazine derivative or (a pyridinium compound), the nuclear promoting agent or the tetrazolium compound used in the invention can be added to any layer on the silver halide emulsion layer side, and preferably to the silver halide emulsion layer or its adjacent layer. The addition amount is preferably $10^{-6}$ to $10^{-1}$ mol/mol of silver, and more preferably $10^{-5}$ to $10^{-2}$ mol/mol of silver, although the optimum amount is different depending on silver halide grain diameter, silver halide grain halide composition, the degree of chemical sensitization, or kinds of restrainers to be used.

The silver halide photographic light sensitive material used in the invention may contain various compounds to prevent fog during the manufacture, storage or photographic processing or to stabilize photographic properties. The compounds include well known compounds as anti-foggants or stabilizing agents such as azoles (benzothiazoliums, nitroindazoles, nitrobenzimidazoles, chlorobenzimidazoles, bromobenzimidazoles, mercaptothiazoles, mercaptobenzothiazoles, mercaptothiadiazoles, aminotriazoles, benzotriazoles, nitrobenzotriazoles), mercaptotetrazoles (especially, 1-phenyl-5-mercaptotetrazoles), mercaptopyrimidines, mercaptotriazines (thioketo compounds such as oxazolinethiones), azaindenes (especially, 4-hydroxy-1,3,3a, 7-tetraazaindenes), pentazaindenes, benzenethiosulfonic acid, benzenesulfinic acid or benzenesulfonamide.

Gelatin is advantageously used as a binder or protective colloid of a photographic emulsion, but another hydrophilic colloid can be used. The examples of the hydrophilic colloid include gelatin derivatives, grafted gelatins with another polymer, proteins such as albumin or casein, cellulose derivatives such as hydroxycellulose, carboxymethylcellulose or cellulose sulfate, saccharides such as sodium alginate or starch derivatives and synthetic hydrophilic polymers such as polyvinyl alcohol, polyvinyl alcohol partial acetal, poly-N-vinyl pyrrolidone, polyacrylic acid, polymethacrylic acid, polyacryl amide, polyvinyl imidazole or polyvinyl pyrazole.

Gelatin includes limed gelatin, acid processed gelatin, gelatin hydrolysate or enzyme decomposed gelatin.

The photographic emulsion in the invention may contain water insoluble or sparingly soluble synthetic polymer in order to improve dimensional stability. The synthetic polymer includes polymers obtained by polymerization of alkyl-(meth)acrylate, alkoxyacryl(meth)acrylate, glycidyl (meth) acrylate, (meth)acryl amide, vinylester such as vinyl acetate, acrylonitrile, olefin, styrene or a combination thereof, or its combination with acrylic acid, methacrylic acid, α,β-unsaturated dicarboxylic acid, hydroxyalkyl-(meth) acrylate, sulfoalkyl(meth)acrylate or styrene sulfonic acid.

As a method of markedly effecting the invention, at least one photographic layer preferably contains a hydrophilic polymer. The hydrophilic polymer includes starch, glucose, dextrin, dextrane, cyclodextrin, sucrose, maltose, and carrageenin. The hydrophilic polymer has a molecular weight of 600 to 1,000,000. The lower the molecular weight is, the better, in view of rapidly dissolving in a processing solution , but 600 or more molecular weight is necessary, since too low molecular weight results in lowering of film strength. Since the hydrophilic polymer reduces film scratch resistance, the film preferably contains an inorganic substance such as colloidal silica, colloidal tin, colloidal zinc, colloidal titanium, colloidal yttrium, colloidal placeodium, neodynium, zeolite, or apatite. The zeolite includes analcite, erionite, mordenite, shabacite, gmelinite, levynite, and the synthetic zeolite includes zeolite A, X, Y and L. The apatite includes hydroxy apatite, fluorine containing apatite and chlorine containing apatite. The addition amount of the inorganic substance is preferably 1 to 200% by weight based on the weight of the hydrophilic binder. When the inorganic substance is surface treated with a silane coupling agent, an emulsion is difficult to coagulate, a coating solution is stabilized and a crack produced due to the inorganic substance is prevented. The silane coupling agent includes triethoxysilanovinyl, trimethoxysilanovinyl, trimethoxypropylmethacrylate, trimethoxysilanopropylglycidyl, 1-mercapto-3-triethoxysilanopropane, 1-amino-3-triethoxysilanopropane, triethoxysilanophenyl, and triethoxymethylsilane. The silane coupling agent is high temperature treated in the prescence of the inorganic substance whereby properties are improved as compared with a simple mixture thereof. The mixing ratio of the agent to the inorganic substance is 1:100 to 100:1.

It is preferable that the silver halide photographic light sensitive material in the invention comprises a support, a silver halide emulsion layer thereon, at least one hydrophilic colloid layer on the surface of the support opposite the emulsion layer and at least one hydrophobic polymer layer on the hydrophilic colloid layer. The hydrophilic colloid layer includes a backing layer. In the invention at least one hydrophobic polymer layer is preferably provided on the backing layer. The hydrophobic polymer layer in the invention cotains a hydrophobic polymer as a binder. The example of the binder includes polyethylene, polypropylene, polystyrene, polyvinyl chloride, polyvinylidene chloride, polyacrylonitrile, polyvinyl acetate, a urethane resin, a urea resin, a melamin resin, a phenol resin, an epoxy resin, fluorine resins such as tetrafluoroethylene and polyvinylidene fluoride, rubbers such as butadiene rubbers, chloroprene rubbers,and natural rubbers, acrylates or methacrylates such as polymethyl methacrylate and polyethylacrylate, polyesters such as polyethylene terephthalates, polyamides such as nylon-6 and nylon-66, a water insoluble polymer such as silicone resins and their derivatives. The binder may be a homopolymer comprising one kind of a monomer or a copolymer comprising two or more kinds of monomers. The preferable binder includes a copolymer of an alkylacrylate or alkylacrylate with acrylic acid or methacrylic acid (preferably containing 5 mol % or less of acrylic acid or methacrylic acid), styrene-butadiene copolymer, styrene-butadiene-acrylic acid copolymer (preferably containing 5 mol % or less of acrylic acid), styrene-butadiene-divinylbenzene-methacrylic acid copolymer (preferably containing 5 mol % or less of methacrylic acid), vinyl actate-ethylene-acrylic acid copolymer (containing 5 mol % or less of acrylic acid), vinylidene chlorideacrylo nitrile-methylmethacrylate-ethylcrylate-acrylic acid copolymer (containing 5 mol % or less of acrylic acid) and ethylacrylate-glycidyl methacrylate-acrylic acid copolymer. These polymers may be used singly or in combination.

The hydrophobic polymer layer optionally contains a photographic additives for example, a matting agent, a surfactant, dyes, a slipping agent, a cross-linking agent, a thickener, a UV absorber and inorganic fine particles such as colloidal silica. These additives are disclosed in Research Disclosure 176, Section 17646 (December, 1978).

The hydrophobic polymer layer may be a single or two or more layers. The thickness of the hydrophobic polymer layer is not specifically limited, but when the hydrophobic polymer layer is too thin, water resistance is insufficient and a backing layer swells in a processing solution. In contrast, when the hydrophobic polymer layer is too thick, a moisture permeation is insufficient of the layer and moisture absorption or desorption of the hydrophilic backing layer is inhibited, resulting in anti-curling property lowering. The thickness of the hydrophobic polymer layer depends on physical properties of a binder used. Accordingly, the thickness is determined considering both. The thickness of the hydrophobic polymer layer is 0.05 to 10 μm, preferably 0.1 to 5 μm, although it depends on the kinds of binders used.

The method of coating a hydrophobic polymer layer is not limited. After a backing layer is coated and dried, a polymer layer may be coated and dried on the backing layer, or a backing layer and a hydrophobic polymer layer may be coated simultaneously and dried. The hydrophobic polymer layer may be coated using a solution in which the binder is dissolved in a solvent or an aqueous dispersion in which the binder is dispersed in water.

A hydrophobic polymer layer is preferably provided on a backing layer on the surface of a support opposite the silver halide emulsion layer of a silver halide photographic light sensitive material, the backing layer being coated on the support surface with an adhesive layer, an antistatic layer and a hydrophilic colloid layer in that order. A protective layer may be coated on the hydrophobic polymer layer. The adhesive layer is provided on a support by coating a vinylidene chloride copolymer or a styrene-glycidyl acrylate copolymer on a support subjected to corona discharge to give a thickness of 0.1 to 1 μm and then coating thereon a gelatin layer containing tin oxide or vanadium pentoxide fine particles having an average diameter of 0.01 to 1$\mu$ doped with indium or phosphor. A styrene sulfonic acid-maleic acid copolymer layer can be cross-linked by a cross-linking agent such as aziridine or a carbonyl active agent as described above. A dye backing layer may be provided on the anti-static layer. The backing layer may contain an inorganic filler for dimensional stability such as colloidal silica, silica or a methyl methacrylate matting agent for anti-slipping, a lubricant for controlling transportability or a release agent. The backing layer may contain a backing dye. The backing dye includes a benzilidene or oxonol dye. These alkali soluble or decomposable dyes can be fixed in a form of fine particles.

The dye concentration for anti-halation is preferably 0.1 to 2.0 in each spectral sensitive wavelength range.

The photographic emulsion or non-light sensitive hydrophilic colloid layer in the invention may contain inorganic or organic hardeners as gelatin hardeners. The hardeners include chromium salts (chrome alum, chromium acetate), aldehydes (formaldehyde, glyoxal, glutaraldehyde), a N-methylol compound (dimethylolurea, methyloldimethylhydantoin), dioxane derivatives (2,3-dihydroxydioxane), active vinyl compounds (1,3,5-triacroyl-hexahydro-s-triazine, bis(vinylsulfonyl)-methylether, active halogen compounds (2,4-dichloro-6-hydroxy-s-triazine), mucohalogen acids (mucochloric acid, phenoxymucochloric acid), isooxazoles, starch dialdehyde, 2-chloro-6-hydroxy-triazinylated gelatin and a carboxy activated hardener. The hardeners may be used singly or in combination. These hardeners are disclosed in Research Disclosure, 176, 17643 (December, 1978), P. 26, Sections A to C. The carboxy activated hardener is especially preferable, and the compounds represented by formulas (1) through (7) on pages 3 to 5 of Japanese Patent O.P.I. Publication No. 5-289219/1993 are preferable and the examples thereof include H-1 through H-39 on pages 6 to 14 of the Japanese Patent.

The photographic emulsion or non-light sensitive hydrophilic colloid layer in the invention may contain a coating auxiliary or various conventional surfactants to prevent static, improve sliding property, help emulsify, prevent adhesion, and improve photographic properties.

Each layer may contain a hydrophilic polymer such as dextrins, starch or glicose in addition to gelatin to adjust degree of swell of the layer. The degree of swell is preferably 120 to 200. Each layer is dried adjusting a drying time or temperature according to the moisture evaporating speed. The drying temperature is 25° to 200° C., and the drying time is 0.1 to 200 seconds. The degree of swell is obtained by measuring sample immersed in water through a microscope or a swell meter. The degree of swell is represented in terms of the following value:

Ld (a dry thickness after storage at 23° C. and 50% RH for 24 hours)×100/Lw (a swell thickness after immersing in 23° C. water)

The surface tension or wetting index is obtained according to a JIS method.

The film surface pH on the silver halide emulsion side is preferably 4.5 to 5.8. The film surface pH is measured after coating and drying. It is obtained by dropping 1 cc water on a film of 1 $cm^3$ and measuring pH through a pH meter. When pH is lowered, an acid such as citric scid, oxalic acid, hydrochloric acid, sulfuric acid, nitric acid, acetic acid or hydrogen carbonate is used, and hen pH is elevated, an alkali agent such as sodium hydroxide, potassium hydroxide, sodium carbonate, sodium bicarbonate or sodium acetate is used. When pH is adjusted on addition of photographic additives, a similar method is used.

The light sensitive material in the invention optionally contains other various photographic additives. The example includes a desensitizing agent, a plasticizer, a slipping agent, a developing accelerator and oil.

The support used in the light sensitive material in the invention may be transparent or non-transparent, but preferably a transparent plastic support. The plastic support includes a support made of polyethylenes (for example, polyethylene terephthalate or polyethylene naphthalate), triacetates (for example, cellulose triacetate) and polystyrenes. Of these, an oriented film support (hereinafter referred to as SPS) made of a syndiotactic polystyrene or a composition containing the same is especially preferable. The SPS is comprised of a styrene homopolymer having a syndiotactic structure but includes a SPS modified with a small amount of a second component (for example, in an amount of 20 mol % or less, preferably 10 mol % or less, more preferably 5 mol % or less. The second component includes an olefin such as ethylene, propylene, butene or hexene, a diene such as butadiene or isoprene, a cyclic olefin monomer, a cyclic diene monomer and a polar monomer such as methyl methacrylate, maleic anhydride or acrylo nitrile. The SPS is obtained by polymerizing styrene or its derivative in the presence of an organic metal catalyst under an appropriate reaction condition. The syndiotactic polystyrene has not less than 75%, preferably not less than 80% of a recemi diad, or not less than 30%, preferably not less than 50% of a recemi pentad. The SPS may contain a conventional plasticizer as a second component, as long as bending elasticity is not deteriorated, and contains the plasticizer for an appropriate bending elasticity.

SPS is obtained by polymerizing styrene or its derivative in the presence of a titanium compound or trialkylaluminium compound at an appropriate temperature. This method is disclosed in Japanese Patent O.P.I. Publication Nos. 62-187708/1987, 1-46921/1989 and 1-178505/1989. The polymerization degree of SPS is not specifically limited, but the molecular weight of the SPS is preferably 10,000 to 5,000,000. In order to increase bending elastisity of SPS, an optimum orientation condition need be selected. The unoriented film is firstly oriented in the londitudinal direction by 3.3±0.3 times at a temperature within 30°±25° C. of the film transition temperature, that is, at a temperature of 120°±25° C., and then oriented in the lateral direction by 3.6±0.6 times at the same temperature. After the orientation, heat treatment is carried out at 230°±18° C. Two steps of the heat treatment are preferably carried out. Thus, a SPS film having a bending elastisity of 350 $kg/mm^2$ or more is obtained.

A film having such a high bending elastisity is difficult to coat and adhere a photographic layer on the film. The coating method is described in many patent publications and literatures on pages 3 and 4 of Japanese Patent O.P.I. Publication No. 3-54551/1991. For example, as to surface treatment, corona discharge treatment or a subbing layer coating is detailed. The subbing layer comprises vinylidene chloride, methacrylic acid, acrylic acid, itaconic acid or maleic anhydride.

The support thickness is preferably 50 to 250 $\mu$m, more preferably 70 to 200 $\mu$m.

In order to improve anti-curling property, heat treatment is preferably carried out after film formation. The heat treatment is most preferably carried out at a step of the a step from the film formation to emulsion coating, but may be carried out at a step after emulsion coating. The heat treatment is preferably carried out at a temperature of from 45° C. to a glass transition point of the film for 1 second to 10 days. The heat treatment time is preferably within one hour in view of productivity.

Various photographic additives may be added to light sensitive material as a solution in which the additives are dissolved in water or organic solvents or as a dispersion containing water insoluble additives in fine particle forms in water, gelatin or a hydrophilic or hydrophobic polymer. The colorant, dyes, desensitizing dyes, hydrazines, redox compounds anti-foggants or UV absorber can be dispersed through a conventional disperser. The disperser includes a ball mill, a sand mill, a colloid mill, an ultrasonic disperser and a high speed impeller disperser. The dispersed photographic additives have an average size of 100 μm or less, and ordinarily an average size of 0.02 to 20 μm. The dispersion method includes the following:

a method of stirring mechanically with high speed (Japanese Patent O.P.I. Publication No. 58-105141/1983), a method of dissolving additives in an organic solvent while heating and then adding the gelatin or a hydrophilic polymer containing a surfactant or an anti-foam agent to the resulting solution while removing the organic solvent to obtain a dispersion, a method of dissolving additives in a citric acid, acetic acid, sulfuric acid, hydrochloric acid or malic acid solution and then adding the resulting solution to a polymer solution such as a gelatin solution to obtain a dispersion (Japanese Patent O.P.I. Publication No. 50-80119/1975), a method of dissolving additives in an alkaline solution containing sodium hydroxide, sodium bicarbonate, or sodium carbonate and then adding the resulting solution to a polymer solution such as a gelatin solution to obtain a dispersion (Japanese Patent O.P.I. Publication No. 2-15252/1990). For example, hydrazines, which are sparingly soluble in water, can be dissolved according to a method described in Japanese Patent O.P.I. Publication No. 2-3033/1990, and the method applies to other additives. The fixing rate of dyes, sensitizing dyes or restrainers having a carboxyl group is increased in a form of fine crystals employing a chelating capability of the carboxyl group. A sparing soluble salt is preferably formed by adding a calcium or magnesium ion in an amount of 200 to 4000 ppm to a hydrophilic colloid layer. The formation of the sparing soluble salt does not limit the use of other salts. The application of the fine particle dispersion method to sensitizing dyes, colorants, restrainers, accelerators, contrast increasing agents or contrast increasing auxiliary agents is optionally carried out depending on their chemical or physical properties.

In the light sensitive material in the invention, two to ten layers are simultaneously coated on a support at a speed of 30 to 1000 m/minute, using a conventional slide hopper or curtain coating method disclosed in U.S. Pat. Nos. 3,636,374 and 3,508,947. In order to reduce coating unevenness, a surface tension of a coating solution is preferably lowered or the polymer described above, which has thixotropy reducing viscosity by shearing force, is preferably employed.

The light sensitive material in the invention may comprise a cross-over cut layer, an anti-static layer, an anti-halation layer or a back coat layer.

The light sensitive material in the invention is packaged in a conventional packaging method. The light sensitive material is poor in resistance to high temperature or humidity, and the storage under severe circumstances should be avoided. Generally, the light sensitive material is stored at preferably 5° to 30° C. and at a relative humidity of preferably 35 to 60%. The light sensitive material is usually packaged in a polyethylene package to prevent it from moisture. A highly stereoregular polyethylene is prepared employing a metallocene catalyst whereby moisture permeation is minimized. Moisture permeation is also minimized by vacuum evaporation of silica on a polyethylene film to form a 0.1 to 1000μ silica layer.

EXAMPLES

The invention will be detailed in the following examples, but is not limited thereto.

(Preparation of a support)

(Preparation of SPS)

In 200 parts by weight of toluene were reacted 100 parts by weight of styrene, 56 g of triisobutylaluminium and 234 g of pentamethylcyclopentadienyltitanium trimethoxide at 96° C. for 8 hours. To the resulting reaction mixture was added a sodium hydroxide methanol solution and the catalyst was decomposed. Thus, the product was obtained and washed three times with methanol. The yield was 34 parts by weight.

(Preparation of SPS film)

The above obtained SPS was melt-extruded at 330° C. from a T die in a layer form, and brought into contact with a chilling drum and solidified to obtain an unoriented film. The SPS was supplied to the chilling drum at three different speeds. The 1054 μm thick unoriented films were heated at 135° C. and oriented by 3.1 times in a machine direction, then at 130° C. by 3.4 times in a transversal direction and heat set at 250° C. Thus, 130 and 100 μm thick biaxial oriented films were obtained as a support having a bending modulus of elasticity of 450 kg/mm$^2$.

(Subbing layer coating on the SPS film)

Silica was vacuum evaporated on the above obtained SPS film and was coated with an anti-static subbing layer latex solution containing a styrene-glycidylacrylate and tin dioxide fine particles.

(Preparation of silver halide emulsion A)

Silver bromochloride core grains comprised of 70 mol % of silver chloride and silver bromide, which had an average thickness of 0.05 μm and an average diameter of 0.15 μm, were prepared in a double-jet precipitation method. In the process $K_3RuCl_6$ was added in an amount of $8\times10^{-8}$ mol/mol of silver. The shell was formed on the core in a double-jet precipitation method, while $K_2IrCl_6$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.2 mol % of silver iodide and silver bromide), having major face (100), an average thickness of 0.10 μm and an average diameter of 0.25 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in Japanese Patent O.P.I. Publication No. 2-280139/1990). The resulting EAg after the desalting was 190 mv at 50° C.

To the emulsion was added $1\times10^{-3}$ mol per mol of silver of 4-hydroxy-6-methyl-1,3,3a,7-tetrazaindene. Potassium bromide and citric acid were added, and adjusted to be pH 5.6 and EAg 123 mv. To the emulsion were added $12\times10^{-5}$ mol/mol of silver of chloroauric acid and $3\times10^{-6}$ mol/mol of silver of inorganic sulfur and the mixture was chemically ripened at 60° C. to obtain a maximum sensitivity. After the ripening, $2\times10^{-3}$ mol per mol of silver of 4-hydroxy-6-methyl-1,3,3a, 7-tetrazaindene, $3\times10^{-4}$ mol per mol of silver of 1-phenyl-5-mercaptotetrazole and gelatin were added to the emulsion to obtain silver halide emulsion A.

(Preparation of silver halide emulsion B)

Silver iodobromochloride core grains comprised of 60 mol % of silver chloride, 2.5 mol % of silver iodide and silver bromide, which had an average thickness of 0.05 μm and an average diameter of 0.15 μm, were prepared in a double-jet precipitation method. In the process $K_3Rh(H_2O)Br_5$ was added in an amount of $2\times10^{-8}$ mol/mol of silver. The shell was formed on the core in a double-jet precipitation method, while $K_2IrCl_6$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.5 mol % of silver iodobromide), having an average thickness of 0.10 μm and an average diameter of 0.42 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in Japanese Patent O.P.I. Publication No. 2-280139/1990). The resulting EAg after the desalting was 190 mv at 50° C.

To the emulsion was added $1\times10^{-3}$ mol per mol of silver of 4-hydroxy-6-methyl-1,3,3a,7-tetrazaindene. Potassium bromide and citric acid were added, and adjusted to be pH 5.6 and EAg 123 mv. To the emulsion were added $2\times10^{-5}$ mol/mol of silver of chloroauric acid and $3\times10^{-5}$ mol/mol of silver of N,N,N'-trimethyl-N'-heptafluoroselenourea and the mixture was chemically ripened at 60° C. to obtain a maximum sensitivity. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and gelatin were added to the emulsion to obtain silver halide emulsion B.

(Preparation of silver halide photographic light-sensitive material for graphic arts for He—Ar laser light)

On the subbing layer of the above support were simultaneously coated the following gelatin subbing layer composition, Prescription 1 in an amount of 0.5 g/m$^2$ of gelatin, the following silver halide emulsion 1 composition, Prescription 2 in an amount of 1.5 g/m$^2$ of silver and of 0.5 g/m$^2$ of gelatin, the following intermediate layer composition, Prescription 3 in an amount of 0.3 g/m$^2$ of gelatin, the following silver halide emulsion 2 composition, Prescription 4 in an amount of 1.4 g/m$^2$ of silver and of 0.4 g/m$^2$ of gelatin, and the following protective layer composition, Prescription 5 in an amount of 0.6 g/m$^2$ of gelatin, in that order. At the same time as the above coating, on the subbing layer of the support opposite the emulsion layer were simultaneously coated the following backing layer composition, Prescription 6 in an amount of 0.6 g/m$^2$ of gelatin, the following hydrophobic polymer layer composition, Prescription 7 in an amount of 2.9 g/m$^2$ of silver and of 0.5 g/m$^2$ of gelatin, and the following backing protective layer composition, Prescription 8 in an amount of 0.4 g/m$^2$ of gelatin, in that order. Thus, light-sensitive material samples were prepared.

Prescription 1 (gelatin subbing layer composition)

| | |
|---|---|
| Gelatin | 0.5 g/m$^2$ |
| Solid dispersion particles of Dye AD-1 (Average diameter 0.1 μm) | 25 mg/m$^2$ |
| Polystyrene sodium sulfonate (Average molecular weight 500,000) | 10 mg/m$^2$ |
| S-1 (sodium isoamyl-n-decylsulfosuccinate) | 0.4 mg/m$^2$ |

Prescription 2 (silver halide emulsion layer 1 composition)

| | |
|---|---|
| Silver halide emulsion A | 1.5 g//m$^2$ (in terms of silver) |
| Solid dispersion particles of Dye AD-8 (Average diameter 0.1 μm) | 20 mg/m$^2$ |

-continued

| | |
|---|---|
| Cyclodextrin (hydrophilic polymer) | 0.5 g/m$^2$ |
| Sensitizing Dye d-1 | 5 mg/m$^2$ |
| Sensitizing Dye d-2 | 5 mg/m$^2$ |
| Hydrazine derivative: Exemplified Compound H-7 | 20 mg/m$^2$ |
| Redox compound RE-1 | 20 mg/m$^2$ |
| Compound e | 100 mg/m$^2$ |
| Latex polymer f | 0.5 g/m$^2$ |
| Hardener g | 5 mg/m$^2$ |
| S-1 | 0.7 mg/m$^2$ |
| 2-Mercapto-6-hydroxypurine | 5 mg/m$^2$ |
| EDTA | 30 mg/m$^2$ |
| Colloidal silica (average diameter 0.05 μm) | 10 mg/m$^2$ |

Prescription 3 (intermediate layer composition)

| | |
|---|---|
| Gelatin | 0.3 g/m$^2$ |
| S-1 | 2 mg/m$^2$ |

Prescription 4 (silver halide emulsion layer 2 composition)

| | |
|---|---|
| Silver halide emulsion B | 1.4 g/m$^2$ (in terms of silver) |
| Sensitizing Dye d-1 | 3 mg/m$^2$ |
| Sensitizing Dye d-2 | 3 mg/m$^2$ |
| Hydrazine derivative: Exemplified Compound H-20 | 20 mg/m$^2$ |
| Nuclear promoting compound Nb-12 | 40 mg/m$^2$ |
| Redox compound RE-2 | 20 mg/m$^2$ |
| 2-Mercapto-6-hydroxypurine | 5 mg/m$^2$ |
| EDTA | 20 mg/m$^2$ |
| Latex polymer f | 0.5 g/m$^2$ |
| S-1 | 1.7 mg/m$^2$ |

Prescription 5 (emulsion protective layer composition)

| | |
|---|---|
| Gelatin | 0.6 g/m$^2$ |
| Solid dispersion particles of Dye AD-5 (Average diameter 0.1 μm) | 40 mg/m$^2$ |
| S-1 | 12 mg/m$^2$ |
| Matting agent (monodispersed silica of an average diameter 3.5 μm) | 25 mg/m$^2$ |
| Nuclear promoting compound Na-3 | 40 mg/m$^2$ |
| 1,3-Vinylsulfonyl-2-propanol | 40 mg/m$^2$ |
| Surfactant h | 1 mg/m$^2$ |
| Colloidal silica (average diameter 0.05 μm)) | 10 mg/m$^2$ |
| Hardener K-1 | 30 mg/m$^2$ |

Prescription 6 (backing layer composition)

| | |
|---|---|
| Gelatin | 0.6 g/m$^2$ |
| S-1 | 5 mg/m$^2$ |
| Latex polymer f | 0.3 g/m$^2$ |
| Colloidal silica (average diameter 0.05 μm) | 70 mg/m$^2$ |
| Polystyrene sodium sulfonate (Average molecular weight 500,000) | 20 mg/m$^2$ |
| Compound i | 100 mg/m$^2$ |

Prescription 7 (hydrophobic polymer layer composition)

| | |
|---|---|
| Latex (methylmethacrylate:acrylivc acid = 97:3) | 1.0 g/m$^2$ |
| Hardener g | 6 mg/m$^2$ |

Prescription 8 (protective backing layer composition)
| | |
|---|---|
| Gelatin | 0.4 g/m$^2$ |
| Matting agent (monodispersed polymethyl methacrylate of an average diameter of 5 $\mu$m) | 50 mg/m$^2$ |
| Sodium-di-(2-ethylhexyl)sulfosuccinate | 10 mg/m$^2$ |
| Surfactant h | 1 mg/m$^2$ |
| Dye k | 20 mg/m$^2$ |
| H—(OCH$_2$ OCH$_2$)$_{68}$—OH | 50 mg/m$^2$ |
| Hardener: K-1 | 20 mg/m$^2$ |
Compound i
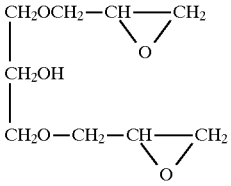
Dye k
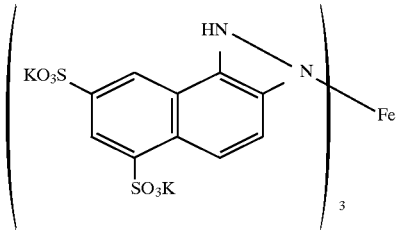
RE-1
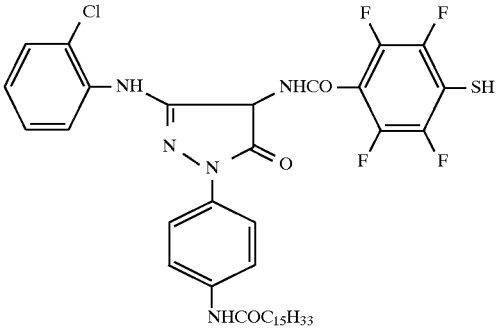
Re-2
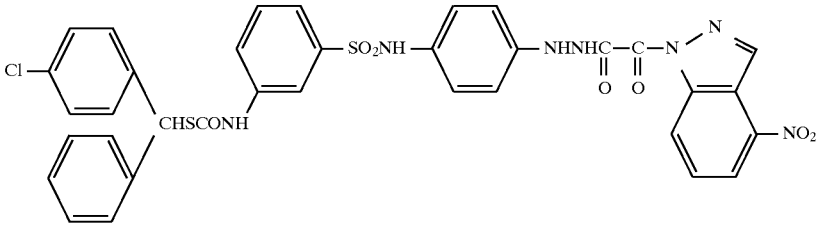
K-1
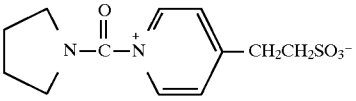

-continued
Sensitizing Dye d-1
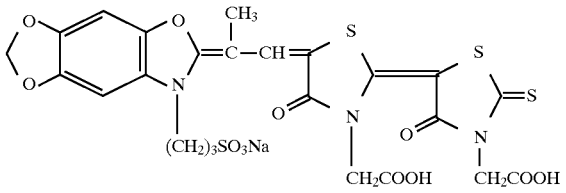
Sensitizing Dye d-2
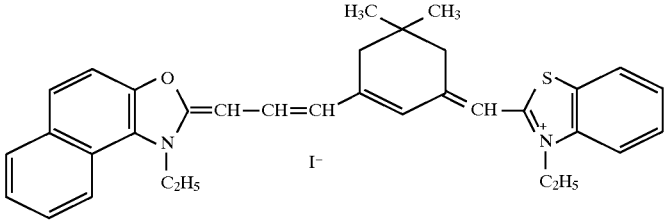
Compound e
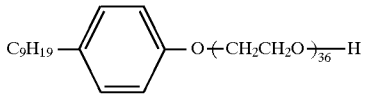
Latex polymer f
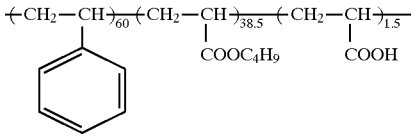
Hardener g
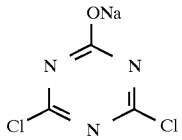
Surfactant h
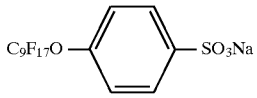
AD-1
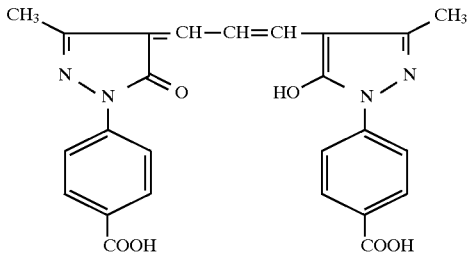

-continued

AD-5

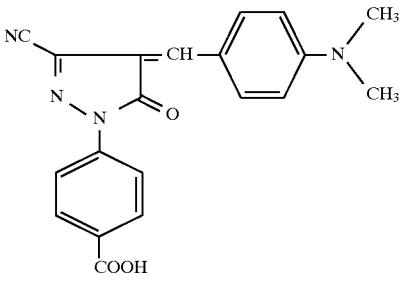

AD-8

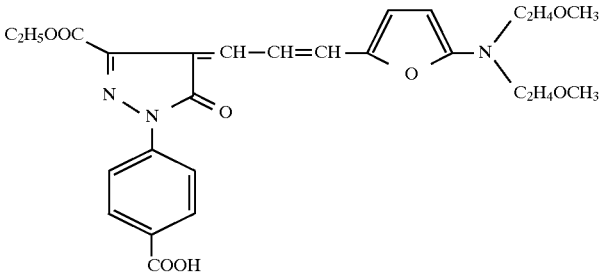

After drying, the surface specific resistance on the backing layer side was $6\times10^{11}$ at 23° C. and 20% RH, and the surface on the emulsion layer side had a pH of 5.5 and a degree of swell of 175. The thus obtained light sensitive material was exposed according to the following exposure and processed in an automatic processor for rapid processing, GR-26SR produced by Konica Corp., which was equipped with a 60° C. heated roller at a drying portion and modified to vary conveying velocity. Each tank was charged with the working developer solution shown later and the following working fixer solution shown later. Thus, 80% of an area of a 610×508 $mm^2$ light sensitive material were exposed. The exposed material was running processed in an amount of 100 sheets per day for 8 days. The running processing was carried out replenishing with 150 $ml/m^2$ of the working developer, 180 $ml/m^2$ of the working fixer and 250 $ml/m^2$ of a rinsing solution. Evaluation was carried out after 800 sheet running processing. The surface specific resistance on the backing layer side after the processing was $3\times10^{11}$ at 23° C. and 20% RH.

Processing solution formula 1. Developer (D-S): (for working solution of 1 liter)

| | |
|---|---|
| Water | 224 ml |
| DTPA · 5Na | 1.00 g (0.002 mol) |
| Sodium sulfite | 31.5 g (0.25 mol) |
| Potassium carbonate | 41.4 g (0.30 mol) |
| Sodum carbonate | 72.4 g (0.70 mol) |
| 8-Mercaptoadenine | 0.06 g |
| Diethylene glycol | 50 g |
| Potassium bromide | 4.72 g (0.04 mol) |
| 5-Methylbenzotrizole | 0.27 g |
| 1-Phenyl-5-mercaptotetrazole | 0.03 g |
| Dimezone S | 1.1 g |
| Sodium erythorbate (A-41) | 35.6 g (0.18 mol) |
| Diethylaminopropane-diol | 25 g |
| Isoelite P (produced by Ensuiko Seito Co., Ltd.) | 20 g |

Using KOH (55% aqueous solution) and water, the total amount was made to 500 ml. Water of 500 ml and the above solution of 500 ml were mixed to make a working developer solution of 1 liter. (Na ratio:81.4%)

2. Preparation of developer-replenishing tablet (D-SR)

Preparation of granules Part A (corresponding to working solution of 1 liter)

| | |
|---|---|
| DTPA · 5Na | 1.00 g (0.002 mol) |
| Sulfite | in an amount as shown in Table 1 |
| 8-Mercaptoadenine | 0.06 g |
| 5-Methylbenzotrizole | 0.27 g |
| Potassium bromide | 4.72 g (0.04 mol) |
| 1-Phenyl-5-mercaptotetrazole | 0.03 g |
| Dimezone S | 1.1 g |
| Sodium erythorbate (A-41) | 35.6 g (0.18 mol) |
| Isoelite P (produced by Ensuiko Seito Co., Ltd.) | 20 g |
| D-Mannitol (produced by Kao Co., Ltd.) | 4 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part A.

Preparation of granules Part B (corresponding to working solution of 1 liter)

| | |
|---|---|
| Carbonate | in an amount as shown in Table 1 |
| D-Mannitol (produced by Kao Co., Ltd.) | 5 g |
| Lithium hydroxide | 3.4 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part B.

Parts A and B were completely mixed over a period of 10 min. and the mixture was tabletted using tabletting machine, Machina UD·DFE30·40 produced by Machina Co., in a loading amount of 9.83 g/tablet at a tabletting pressure of 1.5 ton/$m^2$ to prepare 25 tablets with a diameter of 30 mm and a thickness of 10 mm.

3. Comparative developer replenishing solution (D-LR) (for working solution of 1 liter)

| | |
|---|---|
| Water | 400 ml |
| DTPA · 5Na | 1.00 g (0.002 mol) |
| Sulfite | in an amount as shown in Table 1 |
| Carbonate | in an amount as shown in Table 1 |
| 8-Mercaptoadenine | 0.06 g |
| 5-Methylbenzotrizole | 0.27 g |
| Potassium bromide | 4.72 g (0.04 mol) |
| 1-Phenyl-5-mercaptotetrazole | 0.03 g |
| Dimezone S | 1.1 g |
| Sodium erythorbate (A-41) | 35.6 g (0.18 mol) |
| Isoelite P (produced by Ensuiko Seito Co., Ltd.) | 20 g |
| D-Mannitol (produced by Kao Co., Ltd.) | 7 g |
| Lithium hydroxide | 3.4 g |

Pure water was added to make the total amount of 500 ml. Pure water of 500 ml and the above solution of 500 ml were mixed to make 1 liter of a developer-replenishing solution. The pH of the replenishing solution was 10.40.

4. Fixer (HAF-S): (for working solution of 1 liter)

| | |
|---|---|
| Water | 120 ml |
| Ammonium thiosulfate (10% Na salt, product by Hoechst) | 140 g |
| Sodium sulfite | 22 g |
| Boric acid | 10 g |
| Tartaric acid | 3 g |
| Sodium acetate trihydride | 37.8 g |
| Acetic acid (90% aq. solution) | 13.5 g |
| Aluminum sulfate octadecahydride | 18 g |
| Isoelite P (produced by Ensuiko Seito Co., Ltd.) | 5 g |

Water was added to make the total amount of 500 ml (pH 4.83). Water of 500 ml and the above solution of 500 ml were mixed to make 1 liter of a Fixer-working solution.

Preparation of fixer-replenishing tablet

5. Preparation of granules Part A (corresponding to working solution of 1 liter)

| | |
|---|---|
| Ammonium thiosulfate (10% Na salt, product by Hoechst) | 140 g |
| Sodium bisulfite | 10 g |
| Sodium acetate | 40 g |
| Isoelite P (produced by Ensuiko Seito Co., Ltd.) | 5 g |
| Pineflow (product by Matsugaya Kagaku) | 8 g |

Above materails were mixed over a period of 30 min. by a commercially available mill and granulated at room temperature over a period of 10 min. using a commercially available granulating machine. The resulting granules were dried at 40° C. over a period of 2 hr by a fluidized bed type drying machine to obtain granules of Part A.

Preparation of granules Part B (corresponding to working solution of 1 liter)

| | |
|---|---|
| Boric acid | 10 g |
| Tartaric acid | 3 g |
| Sodium hydrogensulfate | 18 g |
| Aluminum sulfate octadecahydrate | 37 g |
| Pineflow (product by Matsugaya Kagaku) | 4 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules Part B.

Parts A and B were completely mixed over a period of 10 min. and the mixture was tabletted using tabletting machine, Machina UD·DFE30·40 produced by Machina Co., in a loading amount of 11.0 g/tablet at a tabletting pressure of 1.5 ton/$m^2$ to prepare 25 tablets with a diameter of 30 mm and thickness of 10 mm.

The above developers D-S, D-SR and D-LR were kept at 50° C. and 80% RH for 7 days in a sealed vessel made of polyethylene terephthalate and then used. The oxygen permeability of the vessel was 30 ml/atm·$m^2$·25·day.

An automatic processor GR-26 (product by Konica Corp.) was modified to be 8 $cm^2$/liter of a specific surface area (defined in Japanese Patent O.P.I. Publication Nos. 7-77782, Section 0085) of a developer tank and was employed. The replenishing rate of the developer or fixer replenishing solution was 40 ml per sheet of large full size (610×508 mm). Twenty five tablets were dissolved in water through a dissolving mixer and water was added to make a 1 liter solution, and then was employed for replenishing solutions.

Processing condition:

| Step | Temperature | Time |
|---|---|---|
| Developing | 35° C. | 30 sec. |
| Fixing | 34° C. | 20 sec. |
| Washing | Ordinary temp. | 20 sec. |
| Drying | 45° C. | 20 sec. |
| Line-speed (conveying speed): 984 mm/min. | | |
| Evaluation | | |

The light sensitive material was processed using a fresh solution or running solution as a developer and evaluated with respect to sensitivity, gamma (γ) and dot quality (DQ). As the running solution was used a developer solution after 1000 sheets of the light sensitive material with 508×610 mm size, half of each material being light-exposed with a He—Ne laser, were processed.

Sensitivity:

Instead of exposure to He—Ne laser, the light sensitive material was exposed through 633 nm interference filter for $6\times10^{-6}$ sec. and processed in the same manner as above. Sensitometry was made with a densitometer PDA-65 (product by Konica). Sensitivity was shown as a relative value, based on the sensitivity at a density of 2.5 of the light sensitive material processed with the fresh solution being 100.

Gamma (γ):

Gamma is a gradation, defined as a tangent between densities of 0.1 and 3.0 (alternatively, a slope of a line connecting two points corresponding densities of 0.1 and 3.0). In case of a γ-value of less than 6, the light sensitive material is impractical and even in case of not less than 6 and less than 10, it is insufficient contrast. The γ value of not less than 10 produces a super high contrast image which is sufficient for practical use. The results are shown in Table 2.

Dot quality:

The photographic material was exposed through a random-patterned halftone screen with 16 μm dot (FM screen) using SG-747RU (product by Dainippon Screen Co.) and processed to form halftone dot image. Medium dots (aimed at 50% dot) were visually evaluated, using 100 times magnifier, with respect to dot quality based on five grades of 5 (the best level) and 4, 3, 2, and 1 (the worst) along with deterioration of the dot quality. Grades of not more than 2 are outside of practical use. The results are shown in Table 2.

Black spots

The number of black spots in a 2×2 $mm^2$ light sensitive material was counted through a magnifier at a magnification of 40 times. Fifty or more spots can not be put into practical use results are shown in Table 2.

Example 2

The same experiment as Example 1 was carried out, except that the following developer was used:

The light sensitive material and fixer were also the same as Example 1.

Processing solution formula 1. Developer (HD-S): (for working solution of 1 liter)

| | |
|---|---|
| Water | 224 ml |
| DTPA · 5Na | 1.00 g (0.002 mol) |
| Potassium sulfite | 12.54 g (0.091 mol) |
| Sodium sulfite | 42.58 g (0.402 mol) |
| KBr | 4 g (0.0336 mol) |
| $H_3BO_3$ | 8 g |

TABLE 1

| | | Sulfite | | Carbonate | | | Tablet |
|---|---|---|---|---|---|---|---|
| No. | Developer replenisher | $Na_2SO_3$ mol | $K_2SO_3$ mol | $Na_2SO_3$ mol | $K_2SO_3$ mol | Na ratio % | weight g/tablet |
| 1 | D-LR | 0 | 0.25 | 0 | 1 | 8.01 | |
| 2 | D-LR | 0 | 0.25 | 0.5 | 0.5 | 42.83 | |
| 3 | D-LR | 0 | 0.25 | 0.75 | 0.25 | 60.24 | |
| 4 | D-LR | 0.13 | 0.12 | 0.75 | 0.25 | 69.29 | |
| 5 | D-LR | 0.25 | 0 | 0.75 | 0.25 | 77.65 | |
| 6 | D-LR | 0.25 | 0 | 1 | 0 | 95.06 | |
| 7 | D-SR | 0 | 0.25 | 0 | 1 | 8.01 | 10.24 |
| 8 | D-SR | 0 | 0.25 | 0.5 | 0.5 | 42.83 | 9.6 |
| 9 | D-SR | 0 | 0.25 | 0.75 | 0.25 | 60.24 | 9.28 |
| 10 | D-SR | 0.13 | 0.12 | 0.75 | 0.25 | 69.29 | 9.11 |
| 11 | D-SR | 0.25 | 0 | 0.75 | 0.25 | 77.65 | 8.96 |
| 12 | D-SR | 0.25 | 0 | 1 | 0 | 95.06 | 8.64 |

TABLE 2

| | Fresh solution | | | | Running solution | | | | | |
|---|---|---|---|---|---|---|---|---|---|---|
| No. | Sensitivity | γ | DQ (rank) | Black spots (number) | Sensitivity | γ | DQ (rank) | Black spots (number) | Coloration | Remarks |
| 1 | 100 | 15.6 | 4 | 2 | 69 | 9.5 | 2 | 77 | black red | Comp. |
| 2 | 100 | 15.6 | 4 | 2 | 71 | 9.9 | 2 | 75 | black red | Comp. |
| 3 | 100 | 15.6 | 4 | 2 | 75 | 10.2 | 2 | 60 | black red | Comp. |
| 4 | 100 | 15.6 | 4 | 2 | 76 | 11.8 | 3 | 53 | red | Comp. |
| 5 | 100 | 15.6 | 4 | 2 | 79 | 12.6 | 3 | 40 | deep brown | Comp. |
| 6 | 100 | 15.6 | 4 | 2 | 79 | 13.5 | 3 | 40 | deep brown | Comp. |
| 7 | 100 | 15.6 | 4 | 2 | 80 | 14 | 2 | 43 | black red | Comp. |
| 8 | 100 | 15.6 | 4 | 2 | 87 | 14.1 | 3 | 25 | light red | Comp. |
| 9 | 100 | 15.6 | 4 | 2 | 101 | 15.7 | 4 | 3 | slightly red | Inv. |
| 10 | 100 | 15.6 | 4 | 2 | 101 | 15.8 | 4 | 1 | no change | Inv. |
| 11 | 100 | 15.6 | 4 | 2 | 101 | 15.8 | 5 | 0 | no change | Inv. |
| 12 | 100 | 15.6 | 4 | 2 | 102 | 15.8 | 5 | 0 | no change | Inv. |

-continued

| | |
|---|---|
| Potassium carbonate | 55 g (0.399 mol) |
| 8-Mercaptoadenine | 0.07 g |
| Diethylene glycol | 40 g |
| 5-Methylbenzotrizole | 0.21 g |
| 1-Phenyl-5-mercaptotetrazole | 0.03 g |
| Dimezone S | 0.85 g |
| Hydroquinone | 20 g |
| KOH | 18 g (0.321 mol) |

Water is added to make 400 ml. Water of 600 ml and the above solution of 400 ml were mixed to make a working solution of 1 liter. (Na ratio:53%)

2. Preparation of developer-replenishing tablet (HD-SR)

Preparation of granules Part A (corresponding to working solution of 1 liter)

| | |
|---|---|
| DTPA · 5Na | 1.00 g (0.002 mol) |
| Carbonate | in an amount as shown in Table 3 |
| D-Mannitol (producd by Kao Co., Ltd.) | 6.94 g |
| D-Sorbitol | 2.93 g |
| LiOH | 12 g (0.5 mol) |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part A Preparation of granules Part B (corresponding to working solution of 1 liter)

| | |
|---|---|
| Sulfite | in an amount as shown in Table 3 |
| KBr | 2 g (0.0168 mol) |
| $H_3BO_3$ | 4 g |
| 8-Mercaptoadenine | 0.085 g |
| 5-Methylbenzotrizole | 0.26 g |
| 1-Phenyl-5-mercaptotetrazole | 0.06 g |
| Dimezone S | 1.25 g |
| Formula (1) Compound in an amount as shown in Table 3 | |
| Hydroquinone | 20 g |
| Demol N (producd by Kao Co., Ltd.) | 5 g |
| D-Mannitol (producd by Kao Co., Ltd.) | 4.77 g |
| N-lauroyltaulin (producd by Nikko Chemicals Co., Ltd.) | 2 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part B.

Parts A and B were completely mixed over a period of 10 min. and the mixture was tabletted using tabletting machine, Machina UD·DFE30·40 produced by Machina Co., in a loading amount per tablet as shown in Table 3 at a tabletting pressure of 1.5 tons/$m^2$ to prepare 25 tablets with a diameter of 30 mm and a thickness of 10 mm. The 25 tablets were dissolved in water to make a 1 liter solution as a working solution. The pH of the solution was 10.70.

3. Comparative developer replenishing solution (HD-LR) (for working solution of 1 liter)

| | |
|---|---|
| Water | 300 ml |
| DTPA · 5Na | 1.00 g (0.002 mol) |
| Sulfite | in an amount as shown in Table 3 |
| KBr | 2 g (0.036 mol) |
| $H_3BO_3$ | 4 g |
| Carbonate | in an amount as shown in Table 3 |
| 8-Mercaptoadenine | 0.085 g |
| 5-Methylbenzotrizole | 0.26 g |
| 1-Phenyl-5-mercaptotetrazole | 0.06 g |
| Dimezone S | 1.25 g |
| Formula (1) Compound in an amount as shown in Table 3 | |
| Hydroquinone | 20 g |
| LiOH | 12 g (0.5 mol) |
| D-Mannitol (producd by Kao Co., Ltd.) | 11.71 g |
| D-Sorbitol | 2.93 g |
| N-lauroyltaulin (producd by Nikko Chemicals Co., Ltd.) | 2 g |
| Demol N (producd by Kao Co., Ltd.) | 5 g |

Pure water was added to make the total amount of 500 ml. Pure water of 500 ml and the above solution of 500 ml were mixed to make 1 liter of a developer-replenishing solution. The pH of the replenishing solution was 10.70.

The results are shown in Table 3.

TABLE 3

| No. | Developer replenisher | Sulfite $Na_2SO_3$ mol | Sulfite $K_2SO_3$ mol | Carbonate $Na_2SO_3$ mol | Carbonate $K_2SO_3$ mol | Formula (1) Compound | Formula (1) Content mol | Na ratio % | Tablet weight g/tablet |
|---|---|---|---|---|---|---|---|---|---|
| 13 | HD-LR | 0 | 0.45 | 0 | 0.6 | A-41 | 0.014 | 16.58 | |
| 14 | HD-LR | 0 | 0.45 | 0.4 | 0.2 | A-41 | 0.014 | 41.9 | |
| 15 | HD-LR | 0 | 0.45 | 0.6 | 0 | A-41 | 0.014 | 54.56 | |
| 17 | HD-SR | 0 | 0.45 | 0.4 | 0.2 | A-41 | 0.014 | 41.9 | 8.26 |
| 18 | HD-SR | 0.1 | 0.35 | 0.6 | 0 | A-41 | 0.014 | 60.89 | 7.87 |
| 20 | HD-SR | 0.45 | 0 | 0.6 | 0 | A-41 | 0.014 | 83.04 | 7.42 |
| 21 | HD-SR | 0.45 | 0 | 0.6 | 0 | — | 0 | 82.96 | 7.3 |
| 22 | HD-SR | 0.45 | 0 | 0.6 | 0 | A-41 | 0.03 | 83.12 | 7.56 |
| 23 | HD-SR | 0.45 | 0 | 0.6 | 0 | A-41 | 0.06 | 83.28 | 7.82 |

TABLE 3-continued

| No. | Developer replenisher | Sulfite $Na_2SO_3$ mol | Sulfite $K_2SO_3$ mol | Carbonate $Na_2SO_3$ mol | Carbonate $K_2SO_3$ mol | Formula (1) Compound | Formula (1) Content mol | Na ratio % | Tablet weight g/tablet |
|---|---|---|---|---|---|---|---|---|---|
| 24 | HD-SR | 0.45 | 0 | 0.6 | 0 | A-41 | 0.1 | 83.49 | 8.17 |
| 25 | HD-SR | 0.45 | 0 | 0.6 | 0 | A-41 | 0.2 | 83.98 | 9.03 |
| 26 | HD-SR | 0.45 | 0 | 0.6 | 0 | A-41 | 0.5 | 85.3 | 11.62 |
| 27 | HD-SR | 0.45 | 0 | 0.6 | 0 | A-41 | 0.014 | 82.96 | 7.4 |
| 28 | HD-SR | 0.45 | 0 | 0.6 | 0 | A-41 | 0.014 | 82.96 | 7.4 |
| 29 | HD-SR | 0.45 | 0 | 0.6 | 0 | A-41 | 0.014 | 83.04 | 7.42 |

TABLE 4

| No. | Fresh solution Sensitivity | Fresh solution γ | Fresh solution DQ (rank) | Fresh solution Black spots (number) | Running solution Sensitivity | Running solution γ | Running solution DQ (rank) | Running solution Black spots (number) | Coloration | Remarks |
|---|---|---|---|---|---|---|---|---|---|---|
| 13 | 100 | 15.9 | 4 | 4 | 64 | 9.2 | 2 | 98 | black | Comp. |
| 14 | 100 | 15.9 | 4 | 4 | 65 | 9.9 | 2 | 102 | black | Comp. |
| 15 | 100 | 15.9 | 4 | 4 | 75 | 10.2 | 2 | 80 | black | Comp. |
| 17 | 100 | 15.9 | 4 | 4 | 79 | 12.6 | 3 | 66 | black | Comp. |
| 18 | 100 | 15.9 | 4 | 4 | 98 | 15.5 | 4 | 9 | slightly yellow | Inv. |
| 20 | 100 | 15.9 | 4 | 4 | 99 | 15.6 | 4 | 8 | slightly yellow | Inv. |
| 21 | 100 | 15.9 | 4 | 4 | 72 | 14 | 3 | 80 | black | Comp. |
| 22 | 100 | 15.9 | 4 | 4 | 101 | 15.8 | 4 | 1 | no change | Inv. |
| 23 | 100 | 15.9 | 4 | 4 | 101 | 15.8 | 5 | 0 | no change | Inv. |
| 24 | 100 | 15.9 | 4 | 4 | 101 | 16.1 | 5 | 0 | no change | Inv. |
| 25 | 100 | 15.9 | 4 | 4 | 102 | 15.9 | 5 | 0 | no change | Inv. |
| 26 | 100 | 15.9 | 4 | 4 | 103 | 16.1 | 5 | 0 | no change | Inv. |
| 27 | 100 | 15.9 | 4 | 4 | 100 | 16 | 5 | 1 | no change | Inv. |
| 28 | 100 | 15.9 | 4 | 4 | 99 | 15.9 | 5 | 0 | no change | Inv. |
| 29 | 100 | 15.9 | 4 | 4 | 99 | 15.9 | 5 | 1 | no change | Inv. |

In the solid processing composition of the invention, particularly, running stability is excellent.

Example 3

Light sensitive material was running processed in the same manner as in Example 2, except that the following developer replenisher was replenished in an amount of 28 cc per a 610×508 $mm^2$ light sensitive material. The change before and after the running processing were evaluated as to Sensitivity, γ, and black spots. The less the γ and sensitivity changes are and the fewer the black spots are, the more stable the processing.

Preparation of developer-replenishing tablet (HD-SR)

Preparation of granules Part A (corresponding to working solution of 1 liter)

| | |
|---|---|
| DTPA · 5Na | 1.00 g (0.002 mol) |
| Carbonate | 0.6 mol |
| D-Mannitol | 6.94 g |

-continued

| | |
|---|---|
| (produced by Kao Co., Ltd.) | |
| D-Sorbitol | 2.93 g |
| LiOH | 12 g (0.5 mol) |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part A.

Preparation of granules Part B (corresponding to working solution of 1 liter)

| | |
|---|---|
| Sodium sulfite | 0.45 mol |
| KBr | 2 g (0.036 mol) |
| $H_3BO_3$ | 4 g |
| 8-Mercaptoadenine | 0.085 g |
| 5-Methylbenzotrizole | 0.26 g |

-continued

| | |
|---|---|
| 1-Phenyl-5-mercaptotetrazole | 0.06 g |
| Dimezone S | 1.25 g |
| Formula (1) Compound in an amount as shown in Table 5 | |
| Hydroquinone | in an amount as shown in Table 5 |
| Demol N (producd by Kao Co., Ltd.) | 5 g |
| D-Mannitol (producd by Kao Co., Ltd.) | 4.77 g |
| N-lauroyltaulin (producd by Nikko Chemicals Co., Ltd.) | 2 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part B.

Parts A and B were completely mixed over a period of 10 min. and the mixture was tabletted using tabletting machine, Machina UD·DFE30·40 produced by Machina Co., in a loading amount per tablet as shown in Table 5 at a tabletting pressure of 1.5 tons/$m^2$ to prepare 25 tablets with a diameter of 30 mm thickness of 10 mm. The thus obtained 25 tablets were dissolved in water to make a 1 liter solution as a working solution. The pH of the solution was 10.70.

The Na ratio was adjusted to be 83.03% using sodium carbonate or potassium carbonate.

TABLE 5

| | Formula | | | Running solution | | |
|---|---|---|---|---|---|---|
| No. | HQ mol | (1) compound mol | Content ratio of Formula (1) compound to HQ | ΔSensitivity | Δγ | ΔBlack spot number |
| 30 | 0.2 | 0.003 | 0.015 | −10 | −1.1 | 10 |
| 31 | 0.2 | 0.004 | 0.02 | −5 | −0.7 | 5 |
| 32 | 0.2 | 0.015 | 0.075 | −2 | −0.4 | 2 |
| 33 | 0.2 | 0.03 | 0.15 | −1 | −0.3 | −1 |
| 34 | 0.15 | 0.03 | 0.2 | −1 | −0.3 | −1 |
| 35 | 0.1 | 0.05 | 0.5 | 0 | 0 | −1 |
| 36 | 0.05 | 0.1 | 2 | −1 | −0.2 | −1 |
| 37 | 0.03 | 0.15 | 5 | −2 | −0.3 | 2 |
| 38 | 0.01 | 0.15 | 15 | −6 | −0.7 | 6 |
| 39 | 0.01 | 0.2 | 20 | −6 | −0.7 | 7 |
| 40 | 0.01 | 0.25 | 25 | −9 | −1.1 | 13 |
| 41 | 0.005 | 0.25 | 50 | −11 | −1.1 | 15 |

As is apparent from Table 5, the ratio of Formula (1) compound to hydroquinone is preferably 0.02 to 20.

What is claimed is:

1. A solid processing composition for processing a silver halide photographic light sensitive material, the sodium cation content of said solid composition being 80 to 95 mol % based on the total metal cation content, wherein the solid processing composition contains said developing agent represented by the following formula (1-a) in an amount of 30 to 70 weight %:

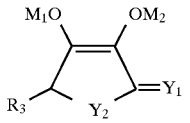

formula (1-a)

wherein $R_3$ represents a hydrogen atom, a substituted or unsubstituted alkyl group, a substituted or unsubstituted aryl group, a substituted or unsubstituted amino group, a substituted or unsubstituted alkoxy group, a sulfo group, a carboxy group, an amido group or a sufonamido group; $Y_1$ represents O or S; $Y_2$ represents O, S or $NR_4$, in which $R_4$ is a substituted or unsubstituted alkyl group or a substituted or unsubstituted aryl group; and $M_1$ and $M_2$ independently represent a hydrogen atom or an alkali metal atom.

2. The solid processing composition of claim 1, further containing hydroquinone.

3. The solid processing composition of claim 2, wherein the content ratio by mol of said developing agent to hydroquinone is 0.02 to 20.

4. The solid processing composition of claim 3, wherein the content ratio by mol of said developing agent to hydroquinone is 0.05 to 5.

5. The solid processing composition of claim 4, wherein the silver halide photographic light sensitive material comprises a hydrazine compound represented by the following Formula [H]:

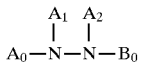

Formula [H]

wherein $A_0$ represents an aliphatic group, an aromatic group or a heterocyclic group; $B_0$ represents —$G_0$—$D_0$—, in which $G_0$ represents —CO—, —COCO—, —CS—, —C(=$NG_1D_1$)—, —SO—, —$SO_2$— or —P(O)($G_1D_1$)— in which $G_1$ represents a single bond, —O—, —S— or —N($D_1$)—, in which $D_1$ represents a hydrogen atom, an aliphatic group, an aromatic group or a heterocyclic group; $D_0$ represents a hydrogen atom, an aliphatic group, an aromatic group, a heterocyclic group, an amino group, an alkoxy group, an aryloxy group, an alkylthio group or an arylthio group; and $A_1$ and $A_2$ represent simultaneously hydrogen atoms or one of $A_1$ and $A_2$ represents a hydrogen atom and the other represents an acyl group, a sulfonyl group or an oxalyl group.

6. The solid processing composition of claim 4, wherein the solid processing composition further contains a water soluble polymer or an alkaline or acidic solution soluble polymer and is in the form of granules or tablets.

7. The solid processing composition of claim 4, wherein said developing agent is ascorbic acid or erythorbic acid.

* * * * *